US008038265B2

(12) United States Patent
Sugahara

(10) Patent No.: US 8,038,265 B2
(45) Date of Patent: Oct. 18, 2011

(54) LIQUID-DROPLET JETTING APPARATUS AND LIQUID-DROPLET JETTING METHOD

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1237 days.

(21) Appl. No.: 11/700,347

(22) Filed: Jan. 31, 2007

(65) Prior Publication Data

US 2007/0176978 A1 Aug. 2, 2007

(30) Foreign Application Priority Data

Jan. 31, 2006 (JP) ..... 2006-022806

(51) Int. Cl.
*B41J 2/045* (2006.01)

(52) U.S. Cl. ..... 347/70; 347/68

(58) Field of Classification Search ..... 347/68–72; 310/365, 366
See application file for complete search history.

(56) References Cited

U.S. PATENT DOCUMENTS

| | | | | |
|---|---|---|---|---|
| 5,742,412 | A * | 4/1998 | Minemoto et al. | 347/20 |
| 6,450,626 | B2 * | 9/2002 | Ikeda et al. | 347/70 |
| 2005/0270340 | A1 * | 12/2005 | Mita | 347/71 |

FOREIGN PATENT DOCUMENTS

| | | |
|---|---|---|
| JP | 11309858 | 11/1999 |
| JP | 2001105613 | 4/2001 |
| JP | 2004106215 | 4/2005 |

* cited by examiner

*Primary Examiner* — Geoffrey Mruk
(74) *Attorney, Agent, or Firm* — Frommer Lawrence & Haug LLP

(57) ABSTRACT

An ink-jet head includes a piezoelectric layer, pressure chambers, nozzles, first electrodes, and second electrodes. When electric potentials of the first and second electrodes respectively are changed at the same timing such that increase and decrease in the electric potentials are opposite between the first and second electrodes, volume of the pressure chamber is changed to apply jetting-pressure to ink in the pressure chamber, thereby jetting an ink droplet from the nozzle. When only the electric potential of the second electrode is changed, the volume of the pressure chamber is changed to apply a vibrating-pressure lower than the jetting-pressure to the ink in the pressure chamber, thereby vibrating meniscus of the ink, agitating the ink in the nozzle. This makes it possible to suppress increase in viscosity of the ink in the nozzle.

20 Claims, 16 Drawing Sheets

LIQUID-DROPLET JETTING APPARATUS AND LIQUID-DROPLET JETTING METHOD

CROSS REFERENCE TO RELATED APPLICATION

The present invention claims priority from Japanese Patent Application No. 2006-022806, filed on Jan. 31, 2006, the disclosure of which is incorporated herein by reference in its entirety.

BACKGROUND OF THE INVENTION

1. Field of the Invention

The present invention relates to a liquid-droplet jetting apparatus which jets a liquid droplet from a nozzle and to a liquid-droplet jetting method.

2. Description of the Related Art

In an ink-jet head (liquid-droplet jetting apparatus) which jets an ink droplet from a nozzle, a viscosity of the ink increases in some cases due to an evaporation of water content (moisture) from the ink in the nozzle. In such a case, a flushing is sometimes performed by jetting the ink droplet from the nozzle so as to prevent a decline in a jetting speed of the ink droplet from the nozzle and/or to prevent any jetting failure of the ink droplet from the nozzle. For example, in an ink-jet head described in Japanese Patent Application Laid-open No. 2001-105613 (FIG. 6), a maintenance such as flushing is performed by a driving signal for flushing including a first driving signal for efficiently discharging unnecessary ink such as high-viscosity ink and solidified ink and a second driving signal for discharging the ink efficiently, upon putting a power supply ON, during a period of time executing a recording (printing) operation, or after the completion of the recording operation. Further, during the period of time executing the recording operation, the recording operation is interrupted when a predetermined amount of recording is performed, and then the recording operation is resumed to be continued after performing the maintenance such as flushing.

SUMMARY OF THE INVENTION

However, in the ink-jet head described in Japanese Patent Application Laid-open No. 2001-105613, it is necessary to perform flushing frequently during a printing operation, for the purpose of preventing the viscosity from increasing in the ink in a nozzle which is less frequently used for the printing. This, however, in turn lowers the printing speed due to the frequent flushing.

An object of the present invention is to provide a liquid-droplet jetting apparatus which is capable of suppressing the increase in viscosity of the ink in the nozzle and to provide a liquid-droplet jetting method.

According to a first aspect of the present invention, there is provided a liquid-droplet jetting apparatus which jets droplets of a liquid to an object, the apparatus including:

a channel unit which includes a plurality of nozzles and a plurality of pressure chambers communicating with the nozzles respectively;

a piezoelectric actuator arranged on a surface of the channel unit and including: a vibration plate which covers the pressure chambers; a piezoelectric layer which is arranged on the vibration plate on a side opposite to the pressure chambers; a plurality of first electrodes which are arranged on a surface of the piezoelectric layer at positions facing the pressure chambers respectively and which apply a first electric potential for providing a jetting-pressure to the liquid in the pressure chambers so as to jet the liquid from the nozzles; a plurality of second electrodes which are mutually conducted and arranged on the surface of the piezoelectric layer at positions facing the pressure chambers respectively, and which apply a second electric potential for providing a vibrating-pressure to the liquid in the pressure chambers so as to vibrate the liquid without jetting the liquid; and a third electrode which is arranged on the other surface of the piezoelectric layer and which faces the first electrodes and the second electrodes across the piezoelectric layer; and an electric potential-changing mechanism which changes an electric potential of the first electrodes to a first electric potential to apply the jetting-pressure to the liquid in the pressure chambers so as to jet the liquid from the nozzles, and which changes an electric potential of the second electrodes to a second electric potential to apply the vibrating-pressure to the liquid in the pressure chambers.

According to the first aspect of the present invention, when the liquid is jetted from the nozzle, the jetting-pressure is applied by the first electrodes to the liquid in the pressure chambers. On the other hand, when the liquid is vibrated, the vibrating-pressure is applied by the second electrodes to the liquid in the pressure chambers, thereby agitating or stirring the liquid in the nozzles. Here, since the second electrodes are in mutual conduction, it is possible to apply the vibrating-pressure concurrently (simultaneously) to the liquid in the plurality of pressure chambers, and to reduce the cost by reducing the number of contact points between the second electrodes and the electric potential-changing mechanism.

In the liquid-droplet jetting apparatus of the present invention, the vibrating-pressure may be applied to the second electrodes to vibrate a meniscus of the liquid in the nozzles. In this case, it is possible to prevent the viscosity of the liquid in the nozzles from being increased.

In the liquid-droplet jetting apparatus of the present invention, the first electrodes may be electrodes which apply the jetting-pressure to the liquid in the pressure chambers; and the second electrodes may be electrodes which apply the vibrating-pressure to the liquid in the pressure chambers. In this case, it is possible to vibrate the meniscus by, for example, applying a predetermined electric potential only to the second electrodes, without allowing the liquid droplets to be jetted from the nozzles. Alternatively, upon jetting the liquid droplets from the nozzles, it is allowable that the predetermined electric potential is applied only to the first electrodes; or electric potentials may be applied to both the first and second electrodes, respectively, so that the first and second electrodes cooperate to allow the liquid droplets to be jetted.

In the liquid-droplet jetting apparatus of the present invention, the vibrating-pressure applied by the second electrodes may be lower than a minimum jetting-pressure with which the liquid in the pressure chambers is jettable from the nozzles. In this case, it is possible to vibrate the meniscus in the nozzles without jetting the liquid therefrom.

In the liquid-droplet jetting apparatus of the present invention, the jetting-pressure applied by the first electrodes may be lower than the minimum jetting-pressure, and a pressure, obtained by combining the jetting-pressure applied by the first electrodes and the vibrating-pressure applied by the second electrodes, may be higher than the minimum jetting-pressure. In this case, it is possible to reduce a change in the electric potential applied to the first electrode, thereby reducing the electric power cost.

In the liquid-droplet jetting apparatus of the present invention, the electric potential-changing mechanism may maintain an electric potential of the third electrode at a predetermined electric potential and may control the electric potentials of the first and second electrodes to generate, at a predetermined cycle, jetting timings in each of which the ink is jetted from the nozzles; and at each of the jetting timings an electric potential of a first electrode selected from the plurality of first electrodes may be changed and the electric potential of the plurality of second electrodes may be changed. In this case, since with respect to all the nozzles, either the liquid droplet is jetted therefrom or the meniscus is vibrated at each of the jetting timings, the increase in the viscosity of ink is prevented in all the nozzles.

In the liquid-droplet jetting apparatus of the present invention, the electric potential-changing mechanism may set the electric potential of the third electrode to a ground electric potential, may selectively apply a predetermined first electric potential and the ground electric potential to the first electrodes, and may selectively apply a predetermined second electric potential and the ground electric potential to the second electrodes. In this case, the number of types of electric potentials set by the electric potential-changing mechanism is reduced, thereby facilitating the control of the electric potential-changing mechanism.

In the liquid-droplet jetting apparatus of the present invention, the first electric potential and the second electric potential may be same. In this case, the number of types of electric potentials set by the electric potential-changing mechanism is reduced, thereby further facilitating the control of the electric potential-changing mechanism.

In the liquid-droplet jetting apparatus of the present invention, the second electric potential may be lower than the first electric potential. In this case, since the vibrating-pressure becomes lower than the jetting-pressure assuredly, it is possible to ensure that the liquid droplets is prevented from being jetted from the nozzles when only the vibrating-pressure is applied.

In the liquid-droplet jetting apparatus of the present invention, one of the first and the second electrodes may be arranged on the surface of the piezoelectric layer at positions each facing a central portion of one of the pressure chambers; and the other of the first and the second electrodes may be arranged on the surface of the piezoelectric layer at positions each located outside the one of the first and the second electrodes. In this case, it is possible to apply the jetting-pressure and the vibrating-pressure efficiently.

In the liquid-droplet jetting apparatus of the present invention, the electric potential-changing mechanism may change the electric potential of the second electrodes at a timing at which the electric potential of the first electrodes is changed, in a negative correlation with a change of the electric potential of the first electrodes. In this case, since it is possible to efficiently change volume of the pressure chambers, a substantial pressure can be applied to the liquid in the pressure chambers.

In the liquid-droplet jetting apparatus of the present invention, each of the first electrodes and each of the second electrodes may be arranged at positions respectively facing a central portion of one of the pressure chambers; and an area of each of the first electrodes may be greater than an area of each of the second electrodes. In this case, it is possible to easily apply the jetting-pressure and the vibrating-pressure. In addition, since the area of the first electrode is greater than the area of the second electrode, the vibrating-pressure is made to be lower than the jetting-pressure assuredly, thereby assuredly preventing the liquid droplets from being jetted from the nozzles when the vibrating-pressure is applied.

In the liquid-droplet jetting apparatus of the present invention, each of the first electrodes and each of the second electrodes may be arranged at positions respectively facing an outer peripheral portion of one of the pressure chambers; and an area of each of the first electrodes may be greater than an area of each of the second electrodes. In this case, it is possible to easily apply the jetting-pressure and the vibrating-pressure. In addition, since the area of the first electrode is greater than the area of the second electrode, the vibrating-pressure is made to be lower than the jetting-pressure assuredly, and thus it is possible to ensure that the liquid droplets are prevented from being jetted from the nozzles when the vibrating-pressure is applied.

In the liquid-droplet jetting apparatus of the present invention, the electric potential-changing mechanism may change the electric potential of the second electrodes at a timing at which the electric potential of the first electrodes is changed, in a positive correlation with a change of the electric potential of the first electrodes. In this case, since it is possible to efficiently change the volume of the pressure chambers, it is possible to apply a substantial jetting-pressure to the liquid in the pressure chambers.

According to a second aspect of the present invention, there is provided a liquid-droplet jetting apparatus which jets droplets of a liquid to an object, the apparatus including:

a channel unit which includes a plurality of nozzles and a plurality of pressure chambers communicating with the nozzles respectively;

a piezoelectric actuator arranged on a surface of the channel unit and including: a vibration plate which covers the pressure chambers; a piezoelectric layer which is arranged on the vibration plate on a side opposite to the pressure chambers; a plurality of first electrodes which are arranged on a surface of the piezoelectric layer at positions facing the pressure chambers respectively; a plurality of second electrodes which are mutually conducted and arranged on the surface of the piezoelectric layer at positions facing the pressure chambers respectively; and a third electrode which is arranged on the other surface of the piezoelectric layer and which faces the first electrodes and the second electrodes across the piezoelectric layer; and a controller which controls electric potentials of the first electrodes and the second electrodes to supply to the first electrodes a first electric potential for jetting the liquid from the nozzles, and to supply to the second electrodes a second electric potential for vibrating the liquid in the nozzles so as to vibrate a meniscus of the liquid in the nozzles.

According to the second aspect of the present invention, it is possible to control the electric potentials applied to the first and second electrodes respectively by the controller. Accordingly, it is possible to easily vibrate the meniscus of the ink without allowing the ink from being jetted from the nozzles.

According to a third aspect of the present invention, there is provided a method for jetting droplets of a liquid to an object by using a liquid-droplet jetting apparatus including: a channel unit which includes a plurality of nozzles and a plurality of pressure chambers communicating with the nozzles respectively; and a piezoelectric actuator which is arranged on a surface of the channel unit and which includes a vibration plate covering the pressure chambers, a piezoelectric layer arranged on the vibration plate on a side opposite to the pressure chambers, a plurality of first electrodes arranged on a surface of the piezoelectric layer at positions facing the pressure chambers respectively, a plurality of second electrodes mutually conducted and arranged on the surface of the piezoelectric layer at positions facing the pressure chambers respectively, and a third electrode arranged on the other surface of the piezoelectric layer and facing the first electrodes and the second electrodes across the piezoelectric layer; the method including:

applying a first electric potential to the first electrodes to jet the liquid in the pressure chambers from the nozzles; and applying a second electric potential to the second electrodes to vibrate a meniscus of the liquid in the nozzles without jetting the liquid in the pressure chambers from the nozzles.

According to the third aspect of the present invention, the electric potentials applied to the first and second electrodes respectively are adjusted independently, thereby making it possible to jet the liquid from the nozzles and to vibrate the meniscus of the liquid without jetting the liquid from the nozzles. Accordingly, it is possible to prevent the ink in the nozzles from being dried and becoming viscous.

DETAILED DESCRIPTION OF THE PREFERRED EMBODIMENTS

A preferred embodiment of the present invention will be described below with reference to the accompanying drawings. This embodiment is an example in which the present invention is applied to an ink-jet head which jets (discharges) an ink from nozzles.

Figure 1:
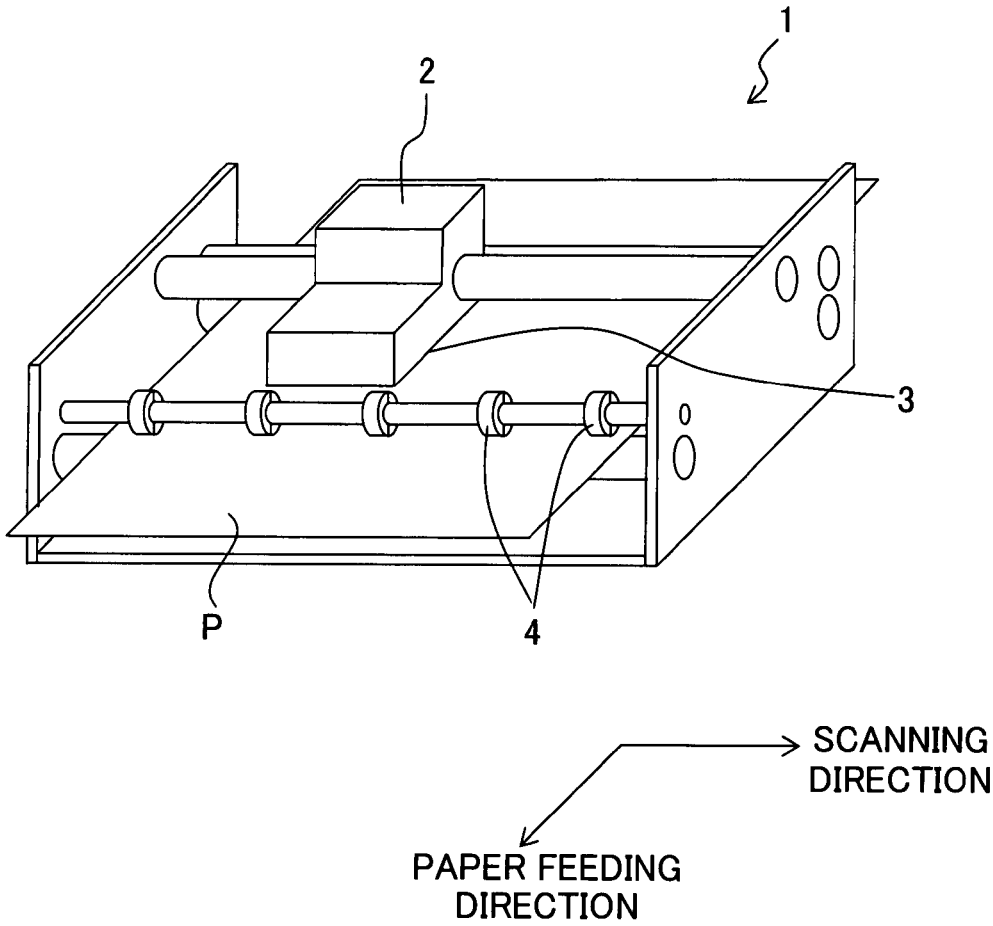
FIG. 1 is a schematic perspective view of an ink-jet printer according to an embodiment of the present invention.

FIG. 1 is a schematic perspective view of an ink-jet printer which includes an ink-jet head according to the present invention. As shown in FIG. 1, an ink-jet printer 1 includes a carriage 2 which is movable in a scanning direction (left and right direction in FIG. 1), an ink-jet head 3 which moves together with the carriage 2 and jets the ink onto a recording paper P, and paper transporting rollers 4 which transports or feed the recording paper P (object) in a paper feeding direction (frontward direction in FIG. 1). The ink-jet head 3 performs printing on the recording paper P by jetting droplets of the ink (ink droplets) from nozzles 15 formed in a lower surface of the ink-jet head 3, while moving integrally with the carriage 2 in the scanning direction (see FIG. 2). The recording paper P, on which the printing has been performed by the ink-jet head 3, is discharged in the paper feeding direction by the paper transporting rollers 4.

Next, the ink-jet head 3 will be described below by referring to FIGS. 2 to 5. As shown in FIGS. 2 to 5, the ink-jet head 3 includes a channel unit 31 in which a plurality of individual ink channels including pressure chambers 10 respectively is formed, and a piezoelectric actuator 32 which is arranged on the upper surface of the channel unit 31.

Figure 4:
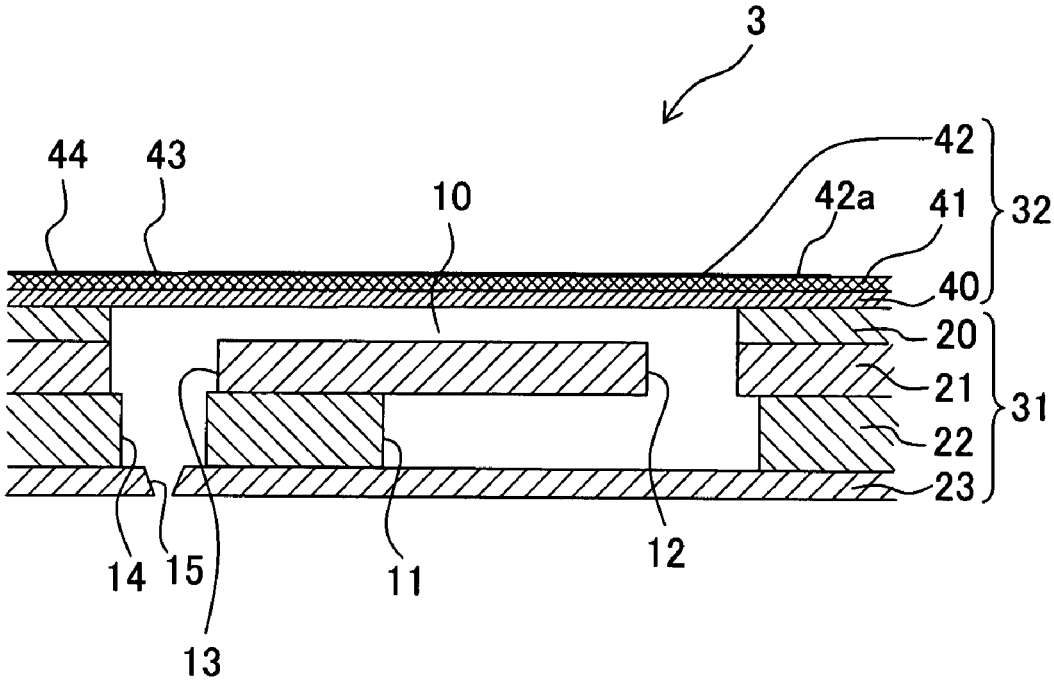
FIG. 4 is a cross-sectional view taken along a line IV-IV shown in FIG. 3.
Figure 5:
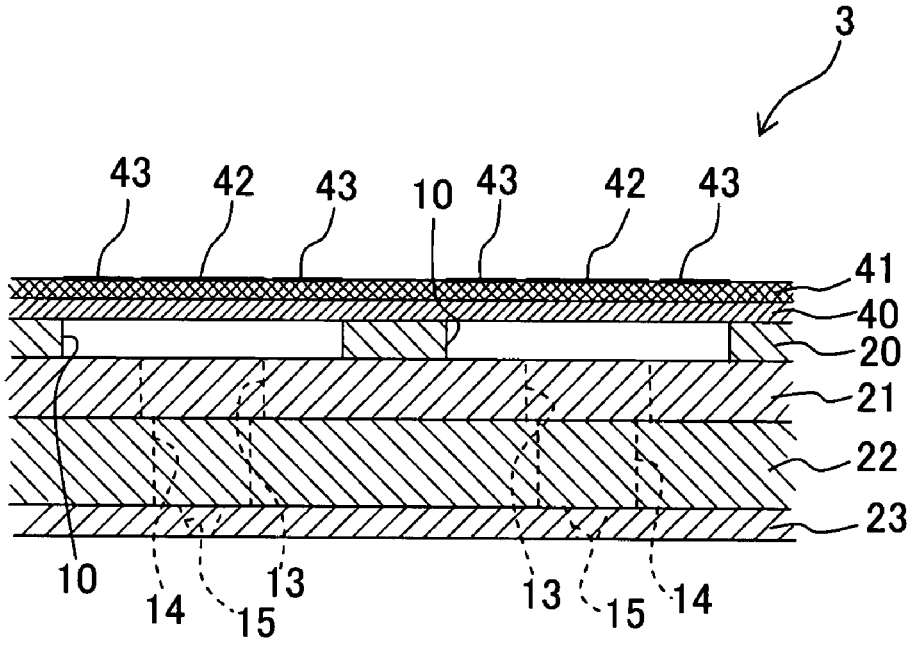
FIG. 5 is a cross-sectional view taken along a line V-V shown in FIG. 3.

As shown in FIGS. 4 and 5, the channel unit 31 includes a cavity plate 20, a base plate 21, a manifold plate 22, and a nozzle plate 23, and is formed by stacking these four plates as laminated layers. Three plates 20 to 22 other than the nozzle plate 23 are formed of a metallic material such as stainless steel. In these three plates 20 to 22, ink channels such as the pressure chambers 10 and manifold channel 11 are formed by etching or the like. The nozzle plate 23 is formed of a synthetic resin material such as polyimide, and is adhered to the lower surface of the manifold plate 22. Alternatively, the nozzle plate 23 may also be formed of a metallic material similarly as the other three plates 20 to 22.

As shown in FIGS. 2 to 5, the pressure chambers 10 are formed in the cavity plate 20 and arranged in the scanning direction (left and right direction in FIG. 2) so as to form two rows of pressure chambers 10 (pressure-chamber rows) in the cavity plate 20. Each of the pressure-chamber rows is extended in the paper feeding direction (up and down direction in FIG. 2), and has five pieces of the pressure chambers 10. Each of the pressure chambers 10 is formed to be substantially elliptical shaped which is long in the scanning direction.

Communicating holes 12 and 13 having a substantially circular shape in a plan view are formed in the base plate 21 at portions overlapping in a plan view with both end portions, respectively, in a longitudinal direction of each of the pressure chambers 10.

A manifold channel 11 extended in the paper feeding direction is formed in the manifold plate 22. The manifold channel 11 overlaps in a plan view with a substantially right half portion of each of the pressure chambers 10 arranged on the right side in FIG. 2 and overlaps in a plan view with a substantially left half portion of each of the pressure chambers 10 arranged on the left side in FIG. 2. The ink is supplied to the manifold channel 11 from an ink supply port 9 formed in a vibration plate 40 which will be described later. Further, communicating holes 14 are formed in the manifold plate 22 at portions overlapping in a plan view with the communicating holes 13 respectively.

Nozzles 15 are formed in the nozzle plate 23 at positions overlapping in a plan view with the communicating holes 14 respectively. When the nozzle plate 23 is formed of a synthetic resin material, it is possible to form the nozzles 15 by a process such as an excimer laser process. Alternatively, when the nozzle plate 23 is formed of a metallic material, it is possible to form the nozzles 15 by a process such as a press working.

The manifold channel 11 communicates with each of the pressure chambers 10 via one of the communicating holes 12. Each of the pressure chambers 10 communicates with one of the nozzles 15 via the communicating holes 13 and 14. Thus, the plurality of individual ink channels communicating the manifold channel 11 with the nozzles 15 via the pressure chambers 10 is formed in the channel unit 31.

Next, the piezoelectric actuator 32 will be described below. As shown in FIGS. 2 to 5, the piezoelectric actuator 32 includes the vibration plate 40 which is electroconductive and is arranged on a surface of the cavity plate 20, a piezoelectric layer 41 which is formed on the upper surface (surface on a side opposite to the pressure chambers) of the vibration plate 40, a plurality of first electrodes 42 and a plurality of second electrodes 43 which are formed on the upper surface of the piezoelectric layer 41, corresponding to the pressure chambers 10, and a wiring 44 which is formed on the upper surface of the piezoelectric layer 41 and which connects the plurality of second electrodes 43.

The vibration plate 40 is made of a metallic material such as an iron alloy like stainless steel, a nickel alloy, an aluminum alloy, a titanium alloy or the like, and is joined to the cavity plate 20, covering the pressure chambers 10. The vibration plate 40 is electroconductive and functions also as a common electrode (third electrode) for generating an electric field in the piezoelectric layer 41 at portions thereof sandwiched between the vibration plate 40 and the first electrodes 42 and in the piezoelectric layer 41 at portions thereof sandwiched between the vibration plate 40 and the second electrodes 43. Further, the vibration plate 40 is always kept at a ground electric potential.

Figure 2:
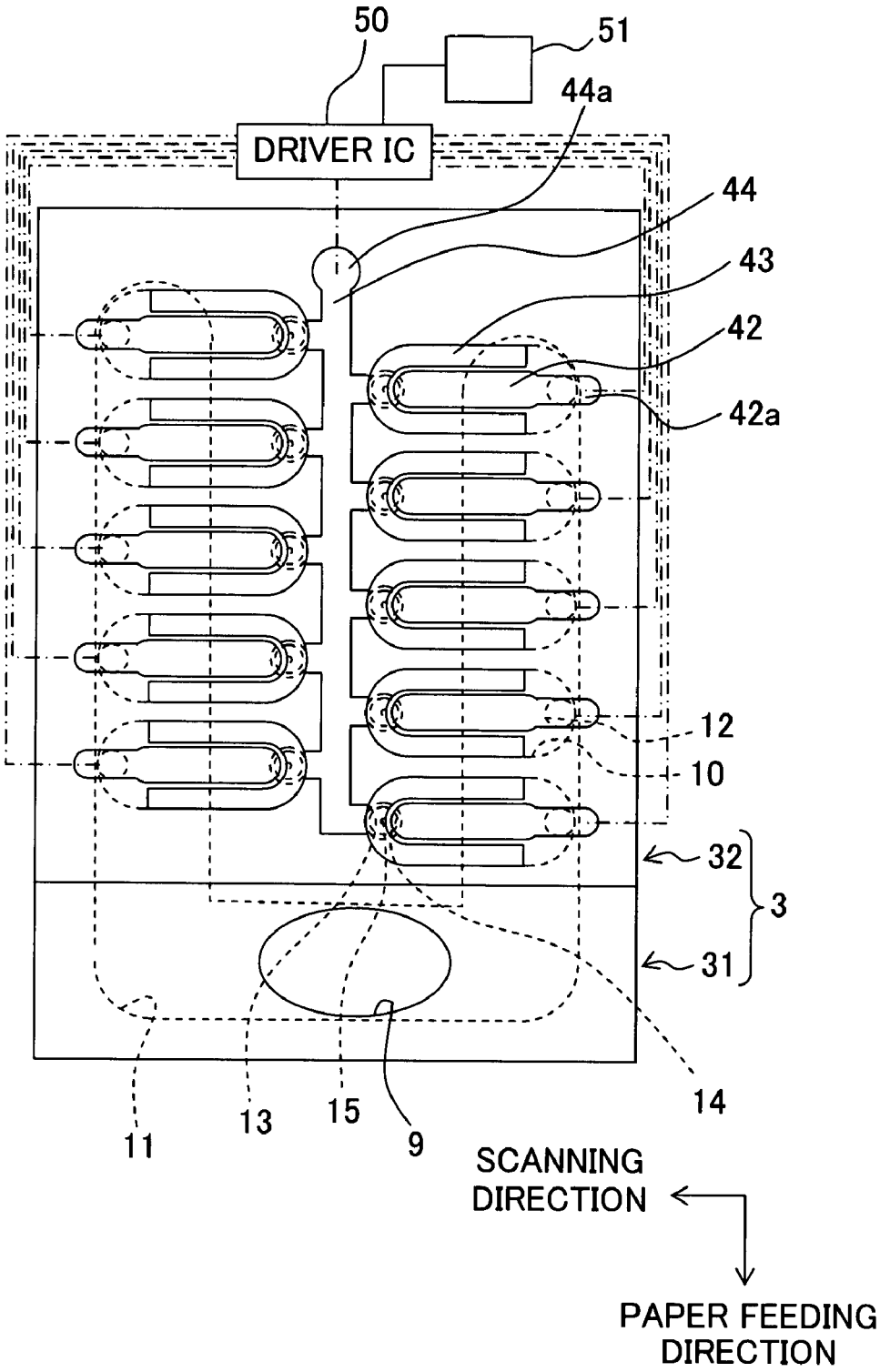
FIG. 2 is a plan view of an ink-jet head shown in FIG. 1.

The piezoelectric layer 41 is formed continuously on the upper surface of the vibration plate 40, so as to cover the pressure chambers 10, at an area other than an area near a lower end portion of the channel unit 31 in FIG. 2. The piezoelectric layer 41 is formed of a piezoelectric material which is mainly composed of lead zirconate titanate (PZT) which is a solid solution of lead titanate and lead zirconate. The piezoelectric layer 41 is formed by an aerosol deposition (AD method) in which ultra fine particles of a piezoelectric material are collided at a high speed onto the upper surface of the vibration plate 40 to be deposited thereon. Alternatively, the piezoelectric layer 41 can be formed also by a method such as a sputtering method, a sol-gel method, a hydrothermal synthesis method, and a chemical vapor deposition (CVD method). Still alternatively, it is also possible to form the piezoelectric layer 41 by sticking, to the upper surface of the vibration plate 40, a piezoelectric sheet or sheets obtained by baking a green sheet of PZT. The piezoelectric layer 41 is polarized in a direction parallel to a direction of its thickness (thickness direction).

Figure 3:
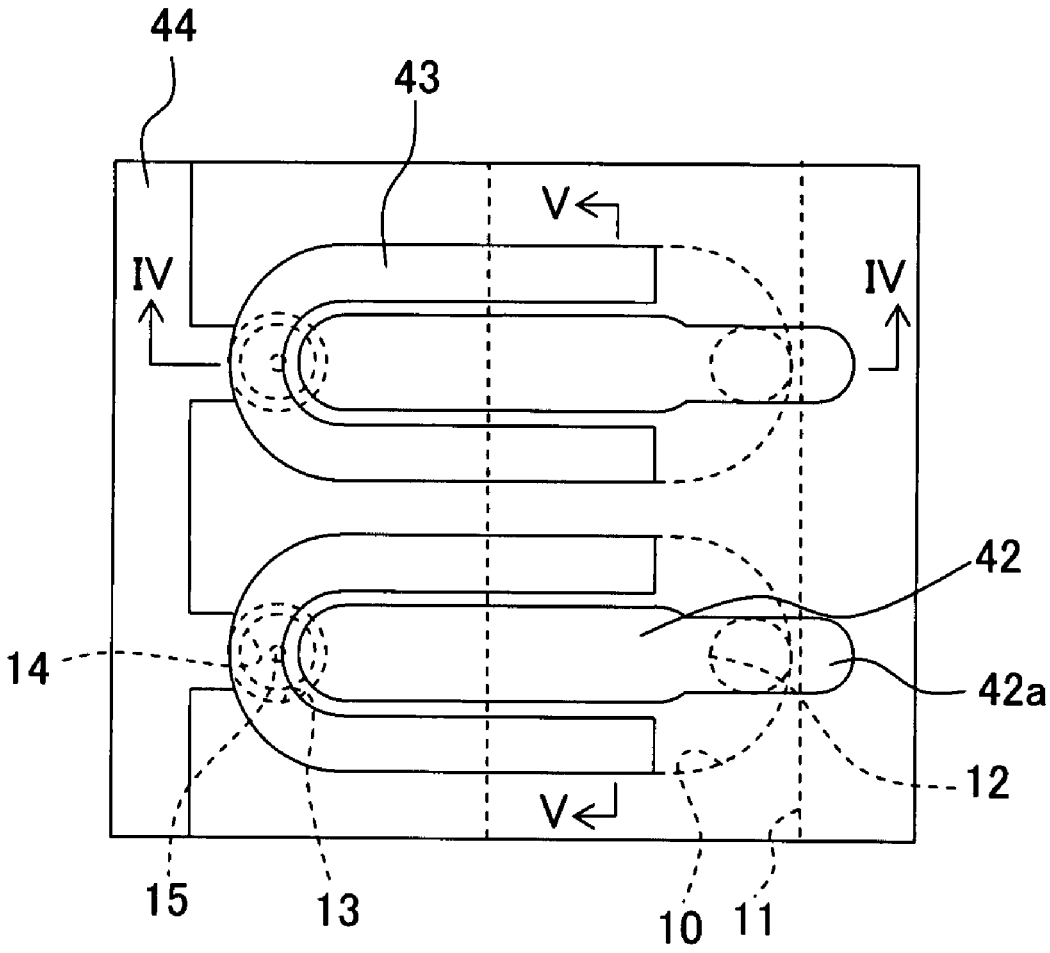
FIG. 3 is a partially enlarged view of FIG. 2.

As shown in FIGS. 2 to 5, the plurality of first electrodes 42 and the plurality of second electrodes 43 are formed on the upper surface of the piezoelectric layer 41, corresponding to the plurality of pressure chambers 10 respectively. As will be described later, each of the first electrodes 42 is an electrode for applying a jetting-pressure to the ink in one of the pressure chambers 10 corresponding to one of the nozzles 15 for which a print command is given (which is to perform the printing) in cooperation with one of the second electrodes 43. As shown in FIGS. 2 and 3, Each of the first electrodes 42 is formed to have a substantially elliptical shape which is slightly smaller than one of the pressure chambers 10, and overlaps in a plan view with a substantially central portion of one of the pressure chambers 10. Each of the first electrodes 42 is extended up to a portion not overlapping in a plan view with any of the pressure chambers 10, the portion being on a side in the longitudinal direction of the pressure chamber 10 which is opposite to the nozzle 15, and this portion forms a contact point 42*a*. Further, each of the first electrodes 42 is connected at the contact point 42*a* to a driver IC (electric potential-changing mechanism, electric potential-setting mechanism) 50, via a flexible printed circuit (FPC) which is not shown in the diagram. The first electrodes 42 are selectively set by the driver IC to have a predetermined first potential V11 (for example, 20 V) or the ground electric potential.

As will be described later, each of the second electrodes 43 is an electrode for applying the jetting-pressure to the ink in one of the pressure chamber 10 corresponding to one of the nozzles 15 for which a print command is given, in cooperation with the one of first electrodes 42, as well as for applying a pressure for imparting vibration (vibrating-pressure), which is smaller (lower) than the jetting-pressure, to the ink in one of the pressure chambers 10 corresponding to one of the nozzles 15 for which the print command is not given (from which the ink is not to be jetted). As shown in FIGS. 2 and 3, each of the second electrodes 43 is formed to have a substantially U-shaped form, at a portion other than a portion in the vicinity of an end portion in the longitudinal direction (right side in FIG. 2) of one of the pressure chambers 10, and is formed outside one of the first electrodes 42 along the outer circumferential portion of one of the pressure chambers 10.

The wiring 44 is formed on the upper surface of the piezoelectric layer 41. The wiring 44 is extended from the second electrodes 43 toward an inner side in the left and right direction in FIG. 2, up to a substantially central portion of the piezoelectric layer 41. Further, the wiring 44 is extended in an upward direction in FIG. 2, up to an area near the upper end portion of the piezoelectric layer 41; and a contact point 44*a* is formed at the upper end portion of the wiring 44. The second electrodes 43 are brought into mutual conduction via the wiring 44. The wiring 44 is connected to the FPC at the contact point 44*a*, and is connected to the driver IC 50 via the FPC. An electric potential of the second electrodes 43 is selectively set, via the wiring 44, to one of the ground electric potential and a predetermined second electric potential V12 (for example, a voltage of 12V, and V12<V11). At this time, the second electrodes 43 are set at a same electric potential via the wiring 44.

The first electrodes 42 are drawn toward outer sides, in the left and right direction, of the piezoelectric actuator 32 in FIG. 2; and the second electrodes 43 are drawn toward the inner side in the left and direction of the piezoelectric actuator 32 in FIG. 2 and are connected to the wiring 44. Here, the first electrodes 42, the second electrodes 43, and the wiring 44 are formed of an electroconductive material such as gold, copper, silver, palladium, and titanium, and can be formed by a method such as a screen printing, the sputtering method.

Figure 6A:
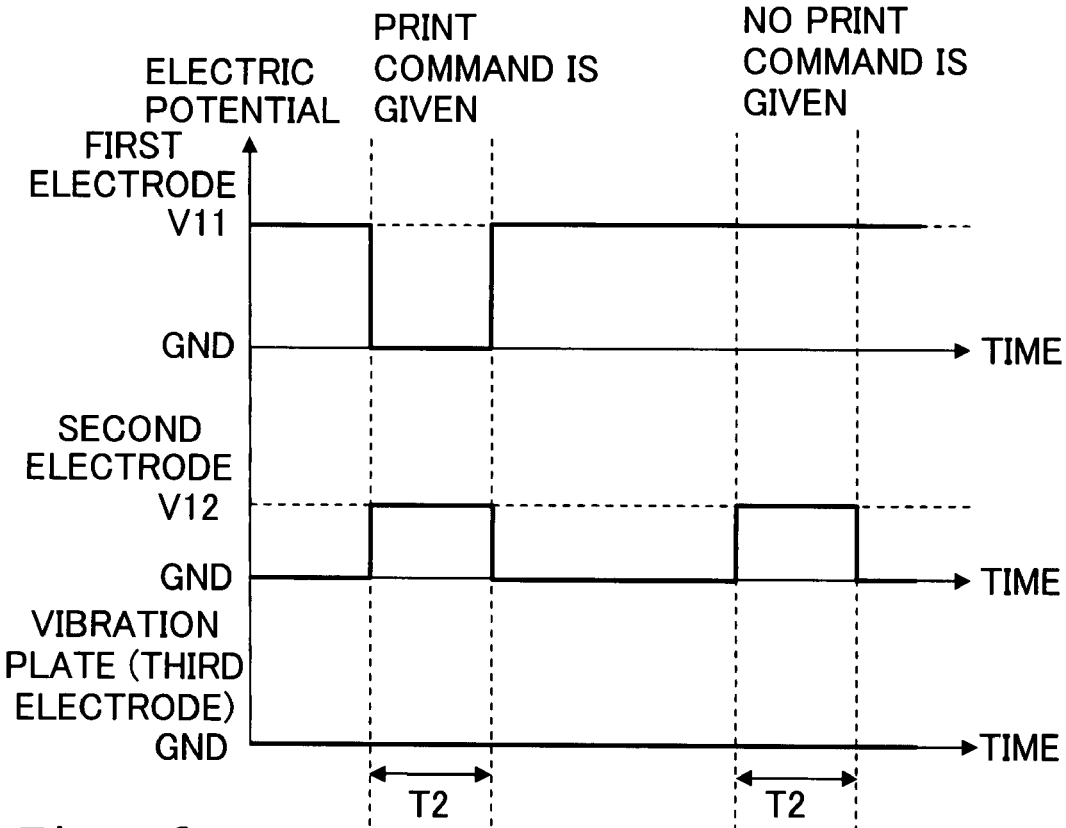
FIG. 6A is a diagram showing a change in an electric potential of each of first and second electrodes in FIG. 2.

Next, an operation of the driver IC 50 will be described with reference to FIG. 6A. FIG. 6A is a diagram showing electric potentials applied to the first electrode 42, the second electrode 43, and the vibration plate (third electrode) 40 respectively by the driver IC 50. The driver IC 50 performs the following operation based on a print command which is given from a controller 51 corresponding to the nozzles 15.

As shown in FIG. 6A, the driver IC 50 applies in advance the electric potential V11 (predetermined first electric potential, a potential of, for example, 20 V) to the first electrodes 42. On the other hand, when a print command is given to a certain nozzle 15 among the nozzles 15, the driver IC 50 changes an electric potential of a certain first electrode 42, included among the first nozzles 15 and corresponding to the certain nozzle 15, to the ground electric potential, and when a time T2 is elapsed, the drive IC changes again the electric potential of the certain first electrode 42 from the ground potential to V11. The driver IC 50 repeats this series of operations at every predetermined cycle T1. Accordingly, a timing to jet the ink (jetting timing) is given to the nozzle 15 at every cycle T1.

Regardless of whether the print command is given or not, the driver IC 50 applies the electric potential V12 (V12<V11, predetermined second electric potential, a potential of, for example, 16 V) to the second electrodes 43 at every predetermined cycle T1 during the time T2, and the drive IC 50 keeps the second electrodes 43 at the ground electric potential for rest of the time other than the predetermined cycle T1.

At this time, as shown in FIG. 6A, a timing at which the electric potential of the first electrode 42 is changed from V11 to the ground electric potential matches with (is concurrent with) a timing at which the electric potential of the second electrode 43 is changed from the ground electric potential to V12, and a timing at which the electric potential of the first electrode 42 is changed from the ground electric potential to V11 matches with a timing at which the electric potential of the second electrode 43 is changed from V12 to the ground electric potential. As described above, the electric potential of the vibration plate 40 is always kept at the ground electric potential.

Figure 6B:
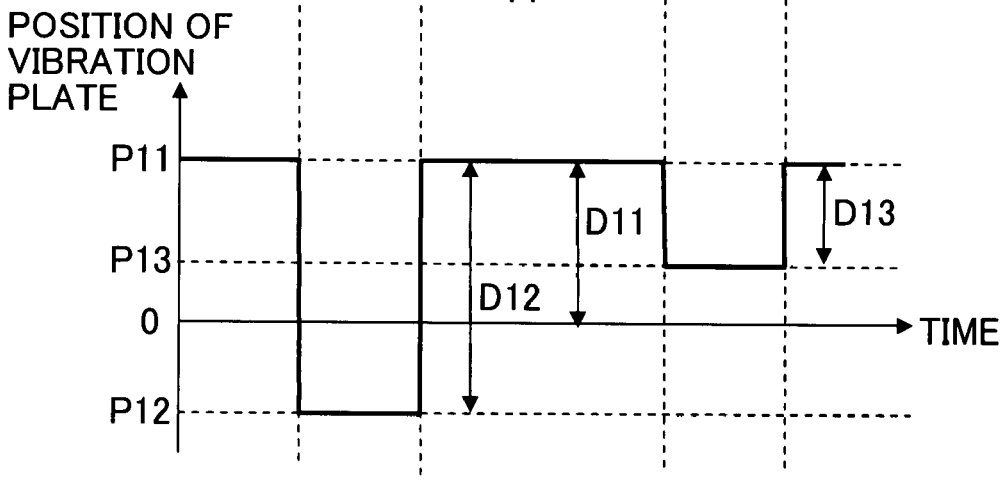
FIG. 6B is a diagram showing a position of a vibration plate corresponding to FIG. 6A.
Figure 7A:
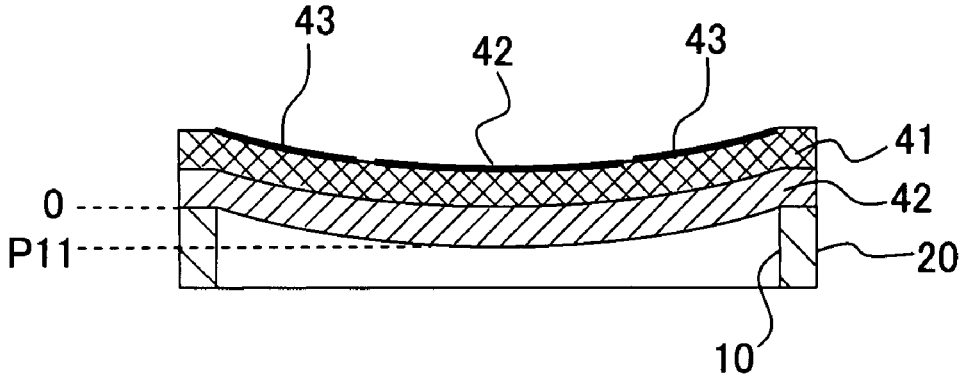
FIGS. 7A to 7C are cross-sectional views showing a deformation of the vibration plate.
Figure 7B:
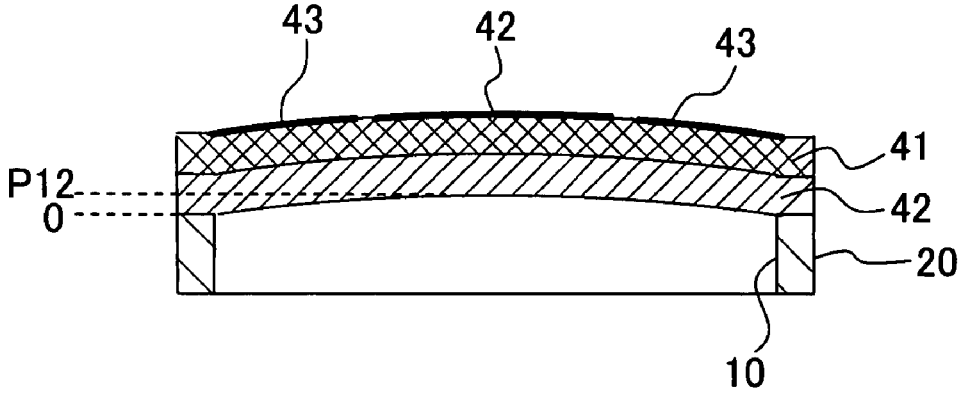
Figure 7C:
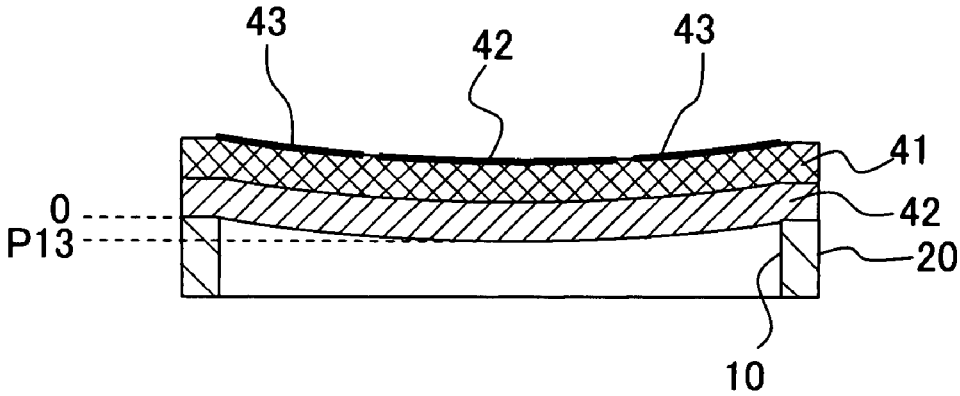

A driving method of the piezoelectric actuator 32 will be described with reference to FIGS. 6A to 8. FIG. 6B shows positions of a central portion of the vibration plate 40 (hereinafter referred simply as position of the vibration plate 40), with respect to a position in which the vibration plate 40 is horizontal (horizontal position), when the electric potential is changed as shown in FIG. 6A. FIGS. 7A to 7C are diagrams each showing a deformation of the vibration plate 40.

Figure 8:
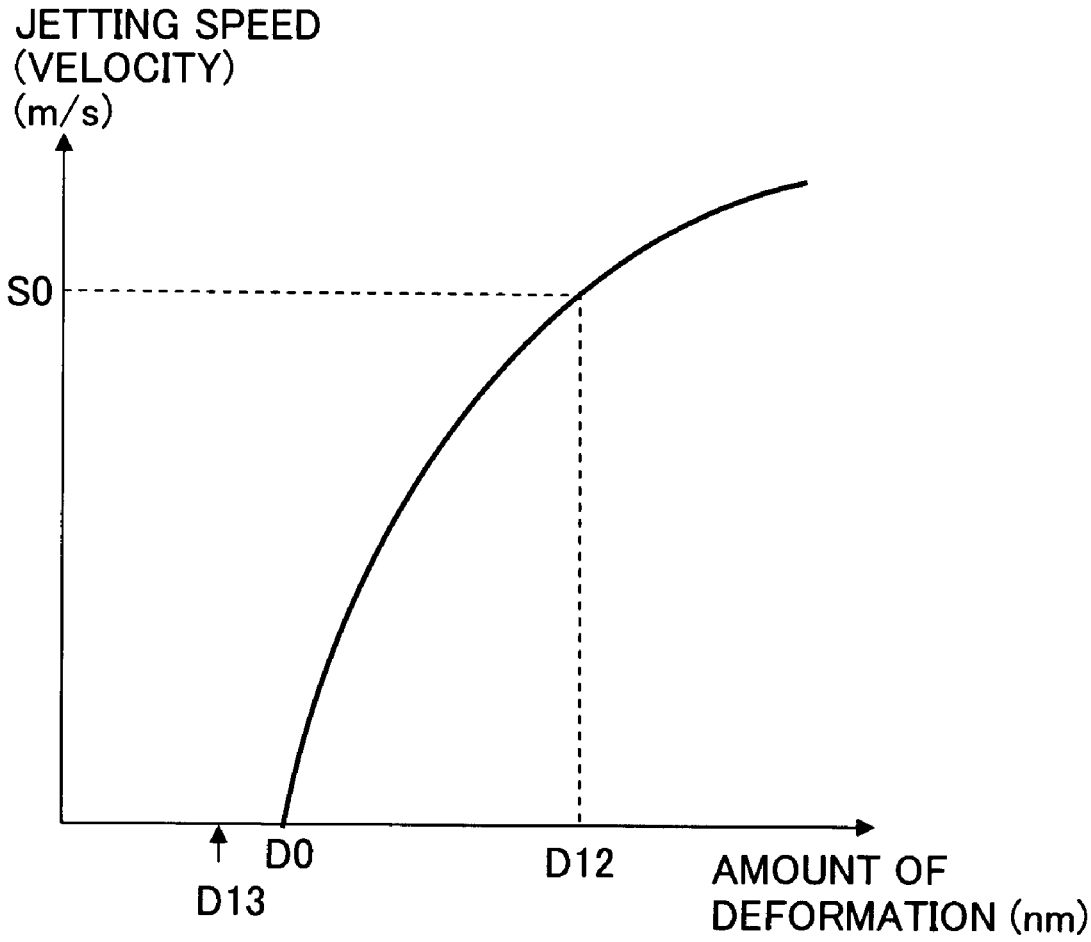
FIG. 8 is a diagram showing a relationship between a deformation amount of the vibration plate and a jetting speed of ink droplet.

FIG. 8 is a diagram showing a relationship between an amount at which the vibration plate 40 is deformed (deformation amount) and a jetting speed of ink droplet jetted from the nozzle 15. In FIG. 6B, a downward direction is a positive direction, and when the vibration plate 40 is deformed toward an upward direction with respect to the horizontal state, the deformation is shown by a negative value.

As described above, the electric potential V11 is applied in advance to the first electrode 42. Accordingly, an electric potential difference is generated between the first electrode 42 and the vibration plate 40 kept at the ground electric potential, and an electric field in the thickness direction is generated in a portion of the piezoelectric layer 41 sandwiched between the first electrode 42 and the vibration plate 40. Since the direction in which the piezoelectric layer 41 is polarized is parallel to the thickness direction, the piezoelectric layer 41 is contracted in a direction of a plane orthogonal to the polarization direction. With the contraction of the piezoelectric layer 41, the vibration plate 40 is deformed downward only by an amount corresponding to D11 to project downwardly. Therefore, when the electric potential of the second electrode 43 is the ground electric potential, the position of the vibration plate 40 becomes P11 as shown in FIGS. 6B and 7A (D11=|P11|).

Upon performing the printing, as shown in FIG. 6A, the electric potential of the second electrode 43 is changed from the ground electric potential to V12, and at the same timing, the electric potential of the first electrode 42 for which the print command is given is changed from V11 to the ground electric potential. Accordingly, the portion, of the piezoelectric layer 41, sandwiched between the first electrode 42 and the vibration plate 40 and has been deformed due to the electric field generated in the sandwiched portion of the piezoelectric layer 40 is returned to its original shape. On the other hand, since an electric field in the direction of thickness is generated in another portion of the piezoelectric layer 41 sandwiched between the second electrode 43 and the vibration plate 40, the piezoelectric layer 41 in this portion is contracted in a horizontal direction. Therefore, a portion of the vibration plate 40 facing a substantially central portion of the pressure chamber 10 is lifted upward. In other words, as shown in FIGS. 6B and 7B, the vibration plate 40 is deformed upward only by an amount corresponding to D12, and the position of the vibration plate 40 becomes P12 (P12<0) (D12=|P11−P12|). Accordingly, a volume of the pressure chamber 10 is increased, and a pressure exerted to the ink in the pressure chamber 10 is decreased, which in turn causes the ink flow from the manifold channel 11 to the pressure chamber 10.

After the time T2 is elapsed, the electric potential of the second electrode 43 is changed from V12 to the ground electric potential, and at the same timing, the electric potential of the first electrode 42 is changed from the ground electric potential to V11. Accordingly, the electric field is generated in the portion of the piezoelectric layer 41 sandwiched between the first electrode 42 and the vibration plate 40, and the portion of the vibration plate 40 facing the substantially central portion of the pressure chamber 10 is deformed downward. In addition, the portion, of the vibration plate 40, sandwiched between the second electrode 43 and the vibration plate 40 and has been deformed due to the electric field generated in the sandwiched portion of the piezoelectric layer 41 is returned to its original shape. In other words, the vibration plate 40 is deformed downward only by the amount corresponding to D12, and the position of the vibration plate 40 becomes the position P11 as shown in FIGS. 6A and 7A. Accordingly, the volume of the pressure chamber 10 is decreased, and the pressure on the ink in the pressure chamber 10 is increased, thereby applying a pressure sufficient for jetting the ink droplet. Thus, upon performing the printing, the electric potentials are changed such that increase and decrease in the electric potential is opposite for the first electrode 42 and the second electrode 43.

As shown in FIG. 8, an ink droplet is jetted from the nozzle 15 only when the deformation amount of the vibration plate 40 is not less than "D0". In other words, when the deformation amount of the vibration plate 40 is D0, the pressure applied to the ink in the pressure chamber 10 is a minimum jetting-pressure which is required for jetting the ink. In this embodiment, V11 and V12 are set such that the deformation amount D12 of the vibration plate 40 is greater than D0, and the ink droplet is jetted at a speed S0 from the nozzle 15 by changing the electric potential of the first electrode 42 and the electric potential of the second electrode 43 corresponding to the nozzle 15 for which the print command is given as described above.

The deformation of the vibration plate 40 at this time is caused by the electric field acting in the portion of the piezoelectric layer 41 sandwiched between the first electrode 42 and the vibration plate 40 and in the portion of the piezoelectric layer 41 sandwiched between the second electrode 43 and the vibration plate 40. On the other hand, when the electric field is generated only in the portion of the piezoelectric layer 41 sandwiched between the first electrode 42 and the vibration plate 40, the vibration plate 40 is deformed only by D11, thereby changing the pressure to the ink in the pressure chamber 10. The deformation amount D11 in this case may be not less than D0, or may be less than D0. In other words, it is allowable that the first electric potential may be determined such that ink droplet is jetted from the nozzle 15 only by the change in the electric potential of the first electrode 42; or it is allowable that the first electric potential and the second electric potential may be determined such that the ink droplet is not jetted from the nozzle 15 only by the change in the electric potential of the first electrode 42, and that the ink droplet is jetted from the nozzle 15 only when the electric potential of the first electrode 42 and the electric potential of the second electrode 43 are changed concurrently as described above.

In any of these cases, the deformation of the vibration plate 40 which is due to the change in the electric potential applied to the first electrode 42 is used for applying the pressure to the ink in the pressure chamber 10 so as to jetting the ink from the nozzle 15. However, in the latter case, since an amount of change in the electric potential of the first electrode 42 can be made to be small as compared to the former case, it is possible to reduce electric power consumption.

On the other hand, electric potential of a first electrode 42 corresponding to a nozzle 15 for which the print command is not given (from which the ink is not jetted) is remained to be V11 as it has been, and only the electric potential of the second electrode 43 is changed. When the electric potential of the second electrode 43 is changed from the ground electric potential to V12, the electric field is generated in the portion of the piezoelectric layer 41 sandwiched between the second electrode 43 and the vibration plate 40, thereby upwardly lifting the portion of the vibration plate 40 facing the substantially central portion of the pressure chamber 10. Accordingly, the vibration plate 40 is deformed upward by only D13, and the position of the vibration plate 40 becomes P3 (D13=|P11−P13| as shown in FIGS. 6B and 7C. Accordingly, the pressure to the ink in the pressure chamber 10 is decreased.

When the electric potential of the second electrode 43 is changed from V12 to the ground electric potential, the vibration plate 40 which is deformed due to the electric field generated in the portion of the piezoelectric layer 41 sandwiched between the second electrode 43 and the vibration plate 40 is returned to its original shape. As shown in FIGS. 6B and 7A, the vibration plate 40 is deformed downward by only D13, and the position of the vibration plate 40 becomes P11. Accordingly, the pressure on the ink in the pressure chamber 10 is increased.

Here, as shown in FIG. 8, when the deformation amount of the vibration plate 40 is not more that D0, the ink droplet is not jetted from the nozzle 15. In this embodiment, V12 is set such that the deformation amount D13 of the vibration plate 40 is smaller than D0, and that no ink droplet is jetted from the nozzle 15. On the other hand, due to a change in the pressure on the ink in the pressure chamber 10 as described above (due to the application of vibrating-pressure), the meniscus of the ink in the nozzle 15 communicating with the pressure chamber 10 is vibrated, and thus the ink in the nozzle 15 is agitated. In other words, the deformation of the vibration plate 40 due to the change in the electric potential applied to the second electrode 43 is used for applying the pressure to the ink in the pressure chamber 10 which in turn vibrates the meniscus of the ink in the nozzle 15. Accordingly, the viscosity of the ink in the nozzle 15 is prevented from being increased. Consequently, the nozzle 15 is hardly clogged, which in turn decrease the frequency at which the flushing is performed for preventing the clogging of the nozzle 15 during printing, thereby enhancing the printing speed.

According to the embodiment described above, by setting the electric potential of the second electrodes 43 to V12 and the ground electric potential concurrently at every predetermined cycle T1, and by deforming the vibration plate 40, the meniscus of the ink in the nozzles 15 is vibrated by applying the vibrating-pressure to the ink in the pressure chambers 10. Therefore, irrespective of whether the print command is given or not (irrespective of the presence or absence of the print command), it is possible to prevent the increase in the viscosity of the ink in the nozzle 15. Accordingly, it is possible to decrease the frequency of performing the flushing for eliminating the clogging of the nozzle 15 during printing, and to improve the printing speed. Furthermore, since the second electrodes 43 are in mutual conduction via the wiring 44, it is possible to apply the vibrating-pressure to the ink in the plurality of pressure chambers 10 concurrently. Further, it is sufficient that the driver IC 50 is connected to the plurality of second electrodes 43 via one contact point 44*a*, and thus it is possible to reduce the cost by decreasing the number of contact points.

Further, the electric potential of the first electrodes 42 each formed at a position overlapping with a substantially central portion of one of the pressure chambers 10, and the electric potential of the second electrodes 43 each formed along the outer circumferential portion of one of the pressure chambers 10 are changed such that the increase and the decrease in the electric potential is mutually opposite for the first and second electrodes 42 and 43. Therefore, it is possible to increase the deformation amount of the vibration plate 40 without increasing the electric potentials applied to the first electrode 42 and the second electrode 43 respectively, and to apply a substantial jetting-pressure to the ink in the pressure chambers 10. Furthermore, at this time also, by changing the electric potential of the first electrode 42 corresponding to the nozzle 15 for which the print command is given, and by changing the electric potential of the second electrode 43 in accordance with the timing at which printing is performed, it is possible to prevent the increase in the viscosity of the ink in the nozzle 15 for which the print command is not given by vibrating the meniscus of the ink in the nozzle 15. Therefore, the control of the electric potential of the second electrode 43 by the driver IC 50 becomes easy.

Further, since the electric potential V12 which is supplied to the second electrode 43 is lower than the electric potential V11 which is supplied to the first electrode 42, it is possible to prevent assuredly the ink droplet from being jetted from the nozzle 15 when the printing is not performed.

Further, the piezoelectric actuator 32 is driven by setting the electric potential of the first electrode 42 to one of V11 and the ground electric potential, and by setting the electric potential of the second electrode 43 to one of V12 and the ground electric potential. Therefore, it is possible to reduce the number of types of electric potentials supplied by the driver IC 50.

As in the case in the embodiment, it is conceivable to adopt the following construction in which, instead of forming both of the first electrodes 42 and the second electrodes 43 on the surface of the piezoelectric layer 41, only the first electrodes 42 are formed on the surface of the piezoelectric layer 41; and after changing the electric potential of all the first electrodes 42 so as to apply the vibrating-pressure at every cycle T1, then the electric potential of a certain first electrode 42, included in the first electrodes 42 and corresponding to a certain nozzle 15 from which the ink droplet is to be jetted, is changed so as to apply the jetting-pressure. Alternatively, another construction is conceivable in which, after changing the electric potential of the first electrode 42 corresponding to the nozzle 15 from which the ink droplet is to be jetted and to which the jetting-pressure is to be applied, then the electric potential of all the first electrodes 42 is changed so as to apply the vibrating-pressure. However, in these cases, in the first electrode 42 corresponding to the nozzle 15 which is to jet the ink droplet, both a time for applying the vibrating-pressure and a time for applying the jetting-pressure are necessary during the cycle T1. Therefore, there is need to increase the length of the cycle T1. In this embodiment, on the other hand, the electric potential of all the second electrodes 43 is changed so as to apply the vibrating-pressure at every cycle T1, and the electric potential of the first electrode 42 corresponding to the nozzle 15 which is to jet the ink droplet is changed so as to apply the jetting-pressure at the same timing. By doing so, the vibrating-pressure and the jetting-pressure are applied concurrently, thereby making it possible to make the length of the cycle T1 to be small.

Next, modifications in which various changes are made in this embodiment will be described below. Same reference numerals are assigned to parts or constructions which are similar to those in the embodiment, and the description therefore will be omitted as appropriate.

First Modification

Figure 9A:
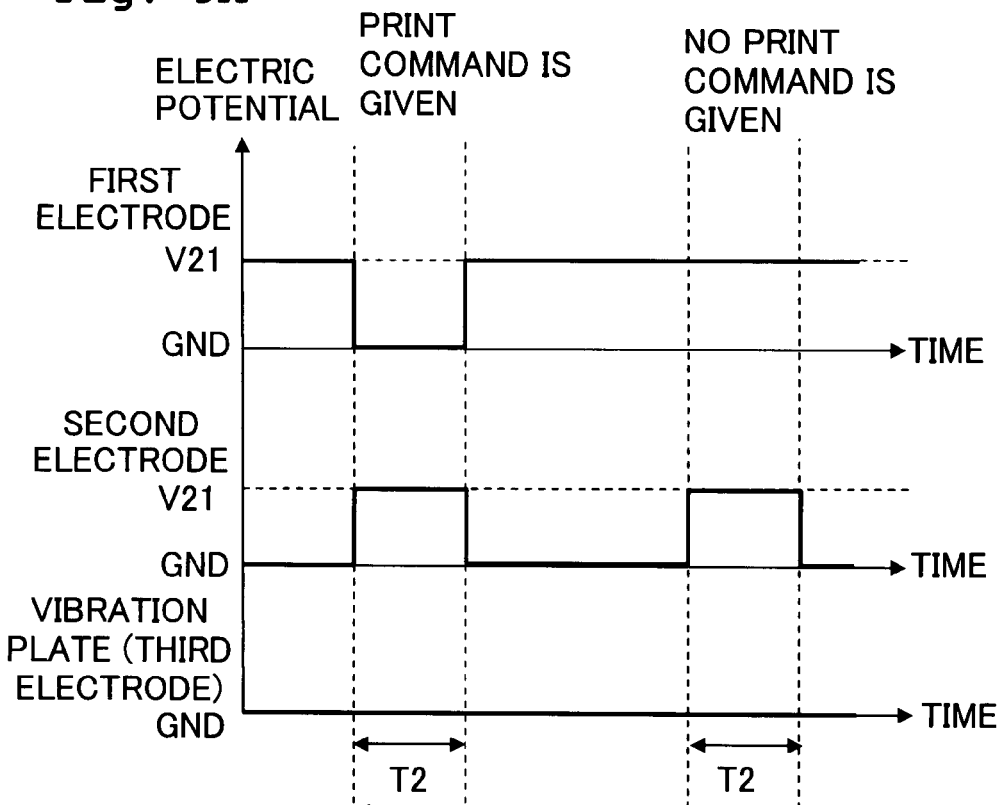
FIGS. 9A and 9B are diagrams of a first modification corresponding to FIGS. 6A and 6B.

As shown in FIG. 9, the electric potential (first electric potential) supplied to the first electrode 42 (see FIG. 2) and the electric potential (second electric potential) supplied to the second electrode 43 (see FIG. 2) may be a same electric potential V21 (for example, 16 V).

In this case, the electric potential V21 is applied in advance to the first electrodes 42. As shown in FIG. 8B, the vibration plate 40 is deformed downward by only D21, and the position of the (deformed) vibration plate 40 is P21 (D21=|P21|).

Further, upon performing printing, the electric potential of the second electrode 43 is changed from the ground electric potential to V21, and at the same timing, the electric potential of a certain first electrode 42 corresponding to a certain nozzle 15 for which the print command is given is changed from V21 to the ground electric potential. Accordingly, the vibration plate 40 is deformed upward by only D22, and the position of the vibration plate 40 becomes P22 (D22=|P21−P22|), and the volume of the pressure chamber 10 is increased. Since the pressure on the ink in the pressure chamber 10 is decreased, the ink flows from the manifold channel 11 to the pressure chamber 10. Then, after the time T2 is elapsed, the electric potential of the first electrode 42 is changed from the ground electric potential to V21, and at the same timing, the electric potential of the second electrode 43 is changed from V21 to the ground electric potential. Since the vibration plate 40 is deformed upward by only D22, the position of the vibration plate 40 is returned to P21. Accordingly, the volume of the pressure chamber 10 is decreased, which in turn applies a pressure capable of jetting the ink is applied to the ink in the pressure chamber 10, thereby jetting the ink droplet from the nozzle 15 communicating with the pressure chamber 10.

Figure 9B:
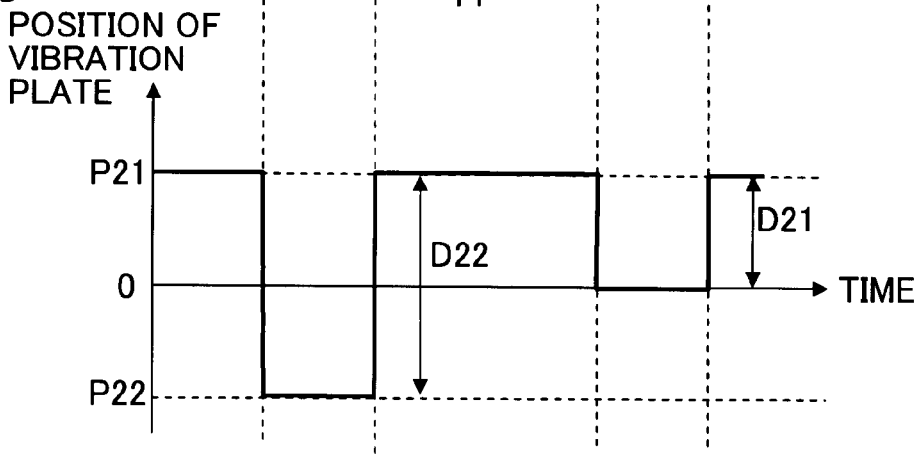

On the other hand, the electric potential of another first electrode 42 corresponding to another nozzle for which the print command is not given is kept at V21, and only the electric potential of the second electrode 43 is changed. When the electric potential of the second electrode 43 changes from the ground electric potential to V21, then as shown in FIG. 9B, the vibration plate 40 is deformed upward by only D21, and the position of the vibration plate 40 becomes 0 (zero). When the electric potential of the second electrode 43 is changed from V21 to the ground electric potential, the vibration plate 40 is deformed downward by only D21 and the position of the vibration plate 40 is returned to P21. Accordingly, the vibrating-pressure is applied to the ink in the pressure chamber 10, and the meniscus of the ink in the nozzle communicating with the pressure chamber 10 vibrates, thereby agitating the ink in the nozzle 15. Consequently, this prevents the increase in the viscosity of the ink in the nozzle 15.

In this case, since the electric potential of each of the first electrode 42 and the second electrode 43 is set to one of V21 and the ground electric potential, it is possible to further reduce the number of types of electric potentials supplied by the driver IC 50 (see FIG. 2). The electric potential V21 supplied to the first and second electrode 42, 43 is set such that the deformation amount D21 of the vibration plate 40 is smaller than D0 and that the deformation amount D22 of the vibration plate 40 is greater than D0.

Second Modification

Figure 10:
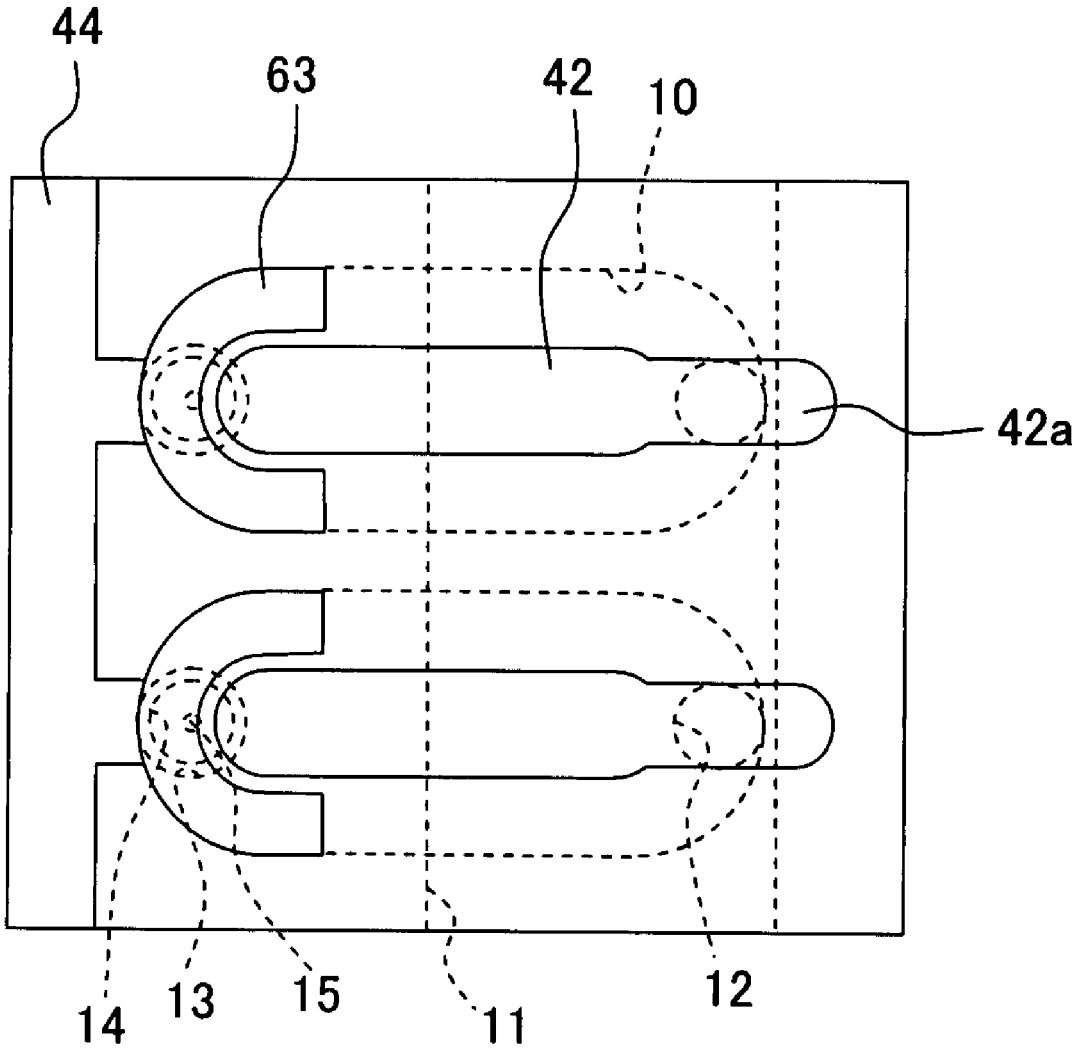
FIG. 10 is a plan view of a second modification corresponding to FIG. 3.

As shown in FIG. 10, second electrodes 63 may be each arranged only along a circumferential portion which is near to an end portion on one side in the longitudinal direction of one of the pressure chambers 10. In this case also, the electric potentials of the first electrode 42 and the second electrode 63 are changed similarly as in the embodiment to apply a pressure, of a magnitude which is capable of jetting the ink, to the pressure chamber corresponding to the nozzle 15 for which the print command is given. Accordingly, it is possible to jet the ink droplet from the nozzle 15. Furthermore, by applying the vibrating-pressure to the ink in the pressure chamber 10 corresponding to the nozzle 15 for which the print command is not given, it is also possible to vibrate the meniscus of the ink in the nozzle 15 and thus to agitate the ink in the nozzle 15 to which no print command is given, thereby preventing the increase in the viscosity of the ink in the nozzle 15.

Third Modification

Figure 11:
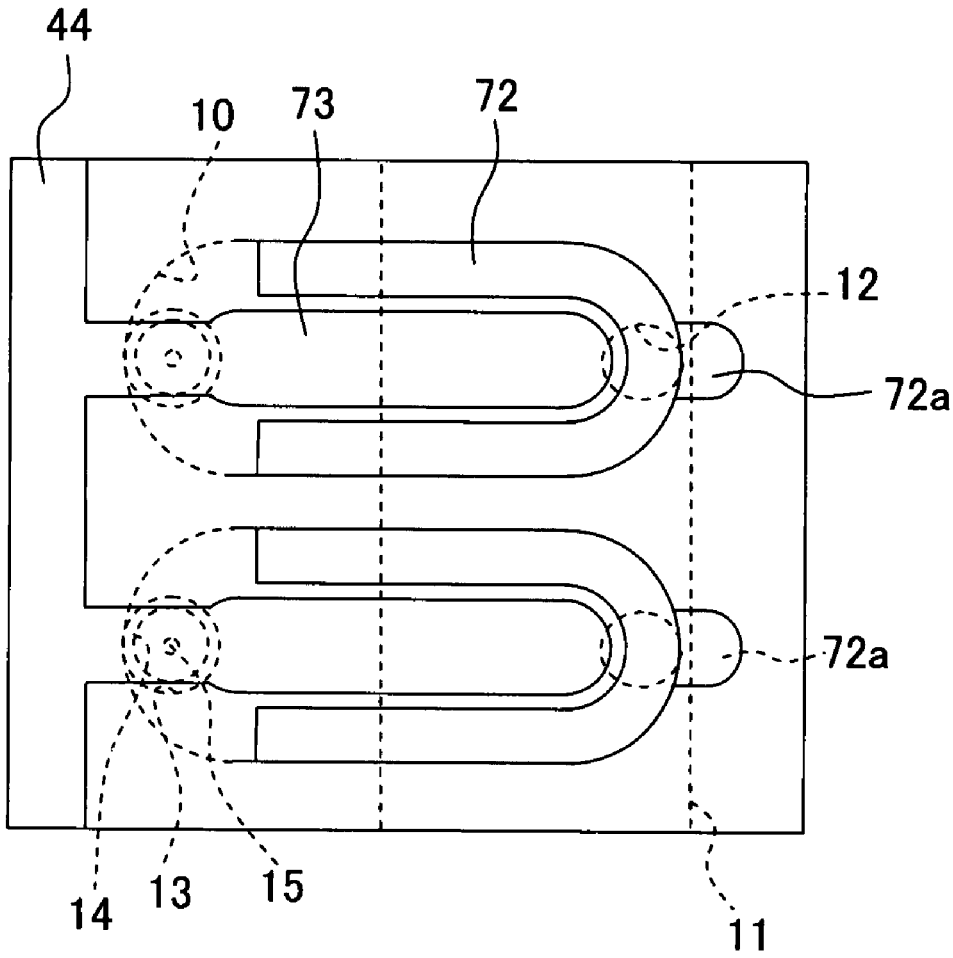
FIG. 11 is a plan view of a third modification corresponding to FIG. 3.

As shown in FIG. 11, first electrodes 72 may be formed each outside a second electrode 73 along an outer circumferential portion thereof and at an area excluding an end portion on one side (left side in FIG. 11) in the longitudinal direction of one of the pressure chambers 10. Further, the second electrode 73 may be arranged to overlap the substantially central portion of one of the pressure chambers 10. In this case, each of the first electrodes 72 is connected to the driver IC 50 (see FIG. 2) by a contact point 72*a* extended from an end portion on one side of the first electrode 72 up to a position not facing any of the pressure chambers 10; and the second electrodes 73, similarly as in the embodiment, are connected to the driver IC 50 via the wiring 44 (see FIG. 2).

In this case, an electric potential of the first electrode 72 and the electric potential of the second electrode 73 are changed such that the change in the electric potentials of the first and second electrodes 72 and 73 are opposite to those (see FIG. 6) of the first electrode 42 (see FIG. 4) and the second electrode 43 (see FIG. 4) in the embodiment as described above. In other words, the electric potentials of the first electrode 72 and the second electrode 73 are decreased at a timing same as the timing at which the electric potentials of the first electrode 42 and the second electrode 43 are increased in the embodiment, as well as the electric potentials of the first electrode 72 and the second electrode 73 are increased at a timing same as the timing at which the electric potentials of the first electrode 42 and the second electrode 43 are decreased in the embodiment. Accordingly, similarly as in the embodiment, it is possible to jet the ink droplet from the nozzle 15 by applying the pressure which is capable of jetting the ink in the pressure chamber 10 corresponding to the nozzle 15 which performs printing. Further, the vibrating-pressure is applied to the ink in the pressure chamber 10 corresponding to the nozzle 15 which does not perform printing so as to vibrate the meniscus of the ink in the nozzle 15 and thus to agitate the ink in the nozzle 15, thereby making it possible also to prevent the increase in the viscosity of the ink in the nozzle 15.

Fourth Modification

Figure 12:
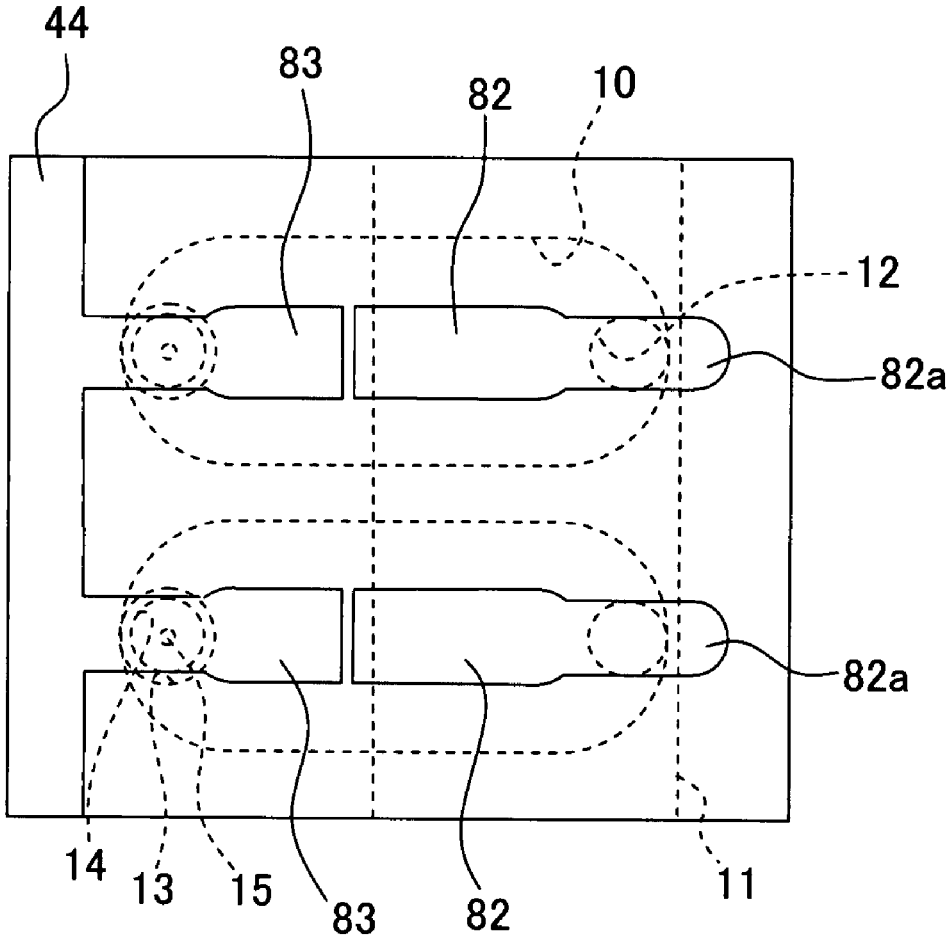
FIG. 12 is a plan view of a fourth modification corresponding to FIG. 3.

As shown in FIG. 12, first and second electrodes 82 and 83 may be arranged to be mutually adjacent in the longitudinal direction of each of the pressure chambers 10, at positions facing the substantially central portion of one of the pressure chambers 10. Here, an area of each of the first electrodes 82 is greater than an area of each of the second electrodes 83. Each of the first electrodes 82 is connected to the driver IC 50 (see FIG. 2) by a contact point 82*a* extended from one end portion (right side in FIG. 12) of the first electrode 82 toward a right side in FIG. 11. The second electrode 83, similarly as in the embodiment, are connected to the driver IC 50 via the wiring 44.

Figure 13A:
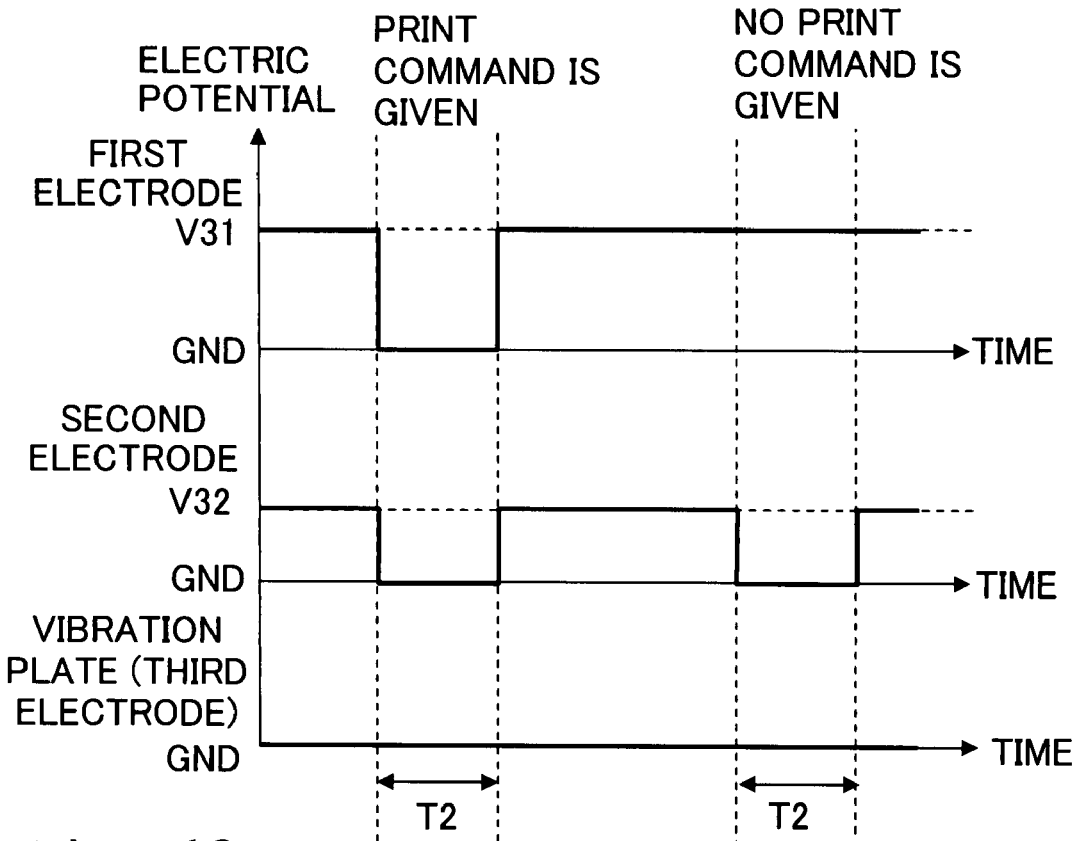
FIGS. 13A and 13B are diagrams of a fourth modification corresponding to FIGS. 6A and 6B, respectively.
Figure 13B:
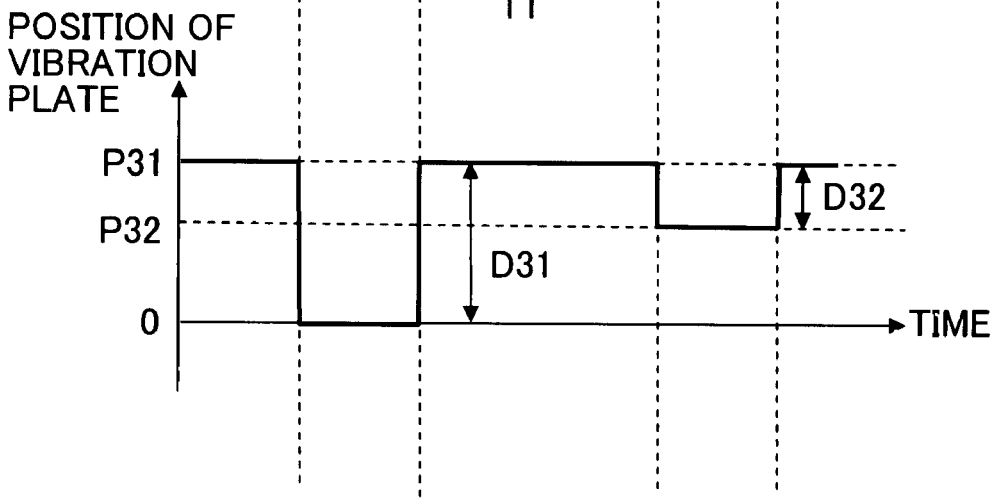

As shown in FIG. 13A, an electric potential V31 (first electric potential) is applied in advance to the first electrodes 82, and an electric potential V32 (V32<V31, second electric potential) is applied to the second electrodes 83. Accordingly, as shown in FIG. 13B, the vibration plate 40 (see FIG. 4) is deformed downward by only D31, and the position of the vibration plate 40 is P31 (D31=|P31|).

Upon performing the printing, the electric potential of the second electrode 83 is changed from V32 to the ground electric potential, and also at the same timing, the electric potential of the first electrode 82, corresponding to the nozzle 15 for which the print command is given, is changed from V31 to the ground electric potential. Accordingly, the vibration plate 40 which has been deformed is returned to its original shape. In other words, as shown in FIG. 13B, the vibration plate 40 is deformed upward by only D31, and the position of the vibration plate becomes 0 (zero). At this time, since the volume of the pressure chamber 10 is increased and the pressure in the pressure chamber 10 is decreased, the ink flows from the manifold channel 11 to the pressure chamber 10. Then, after the time T2 is elapsed, the electric potential of the second electrode 83 is changed from the ground electric potential to V32, and also at the same timing, the electric potential of the first electrode 82 is changed from the ground electric potential to V31. Accordingly, as shown in FIG. 13B, the vibration plate 40 is deformed downward by only D32, and the position of the vibration plate 40 becomes P31. At this time, since the volume of the pressure chamber 10 decreased and the pressure on the ink in the pressure chamber 10 is increased (pressure of a magnitude capable of jetting the ink is applied), the ink droplet is jetted from the nozzle 15.

Thus, in the fourth modification, upon performing printing, when the electric potential of the first electrode 82 is increased, the electric potential of the second electrode 83 is also increased; and when the electric potential of the first electrode 82 is decreased, the electric potential of the second electrode 83 is also decreased. In other words, the electric potential of the second electrode 83 is changed at the same timing as that of changing the electric potential of the first electrode 82, and also the electric potential of the first electrode 82 and the electric potential of the second electrode 83 are changed in a positive correlation with a change of the electric potential of the first electrode.

On the other hand, the electric potential of the first electrode 82 corresponding to the nozzle 15 for which the print command is not given is kept at V31, and only the electric potential of the second electrode 83 is changed. When the electric potential of the second electrode 83 is changed from V32 to the ground electric potential, then the vibration plate 40 is deformed upward by only D32 and the position of the vibration plate 40 becomes P32 (D32=|P31−P32|). When the electric potential of the second electrode 82 is changed from the ground electric potential to V32, the deformation of the vibration plate 40 is reverted so that the vibration plate 40 regains its original shape (the vibration plate 40 is deformed downward by D32 only), and the position of the vibration plate 40 becomes P31 as shown in FIG. 13B. Accordingly, since the pressure on the ink in the pressure chamber 10 is changed (the vibrating-pressure is applied) and the meniscus of the ink in the nozzle 15 is agitated, it is possible to prevent the increase in the viscosity of the ink in the nozzle 15.

Here, since the area of the first electrode 82 is greater than the area of the second electrode 83, the vibrating-pressure becomes assuredly smaller than the pressure of the magnitude capable of jetting. Therefore, it is possible to prevent assuredly the ink droplet from being jetted from the nozzle 15 when the vibrating-pressure is applied to the ink in the pressure chamber 10.

Note that in the fourth modification, V31 and V32 are set such that the deformation amount D31 of the vibration plate 40 shown in FIG. 13B is smaller than the minimum deformation amount D0 (see FIG. 7) necessary for jetting the ink droplet from the nozzle 15, and the deformation amount D32 is greater than the deformation amount D0.

Fifth Modification

Figure 14:
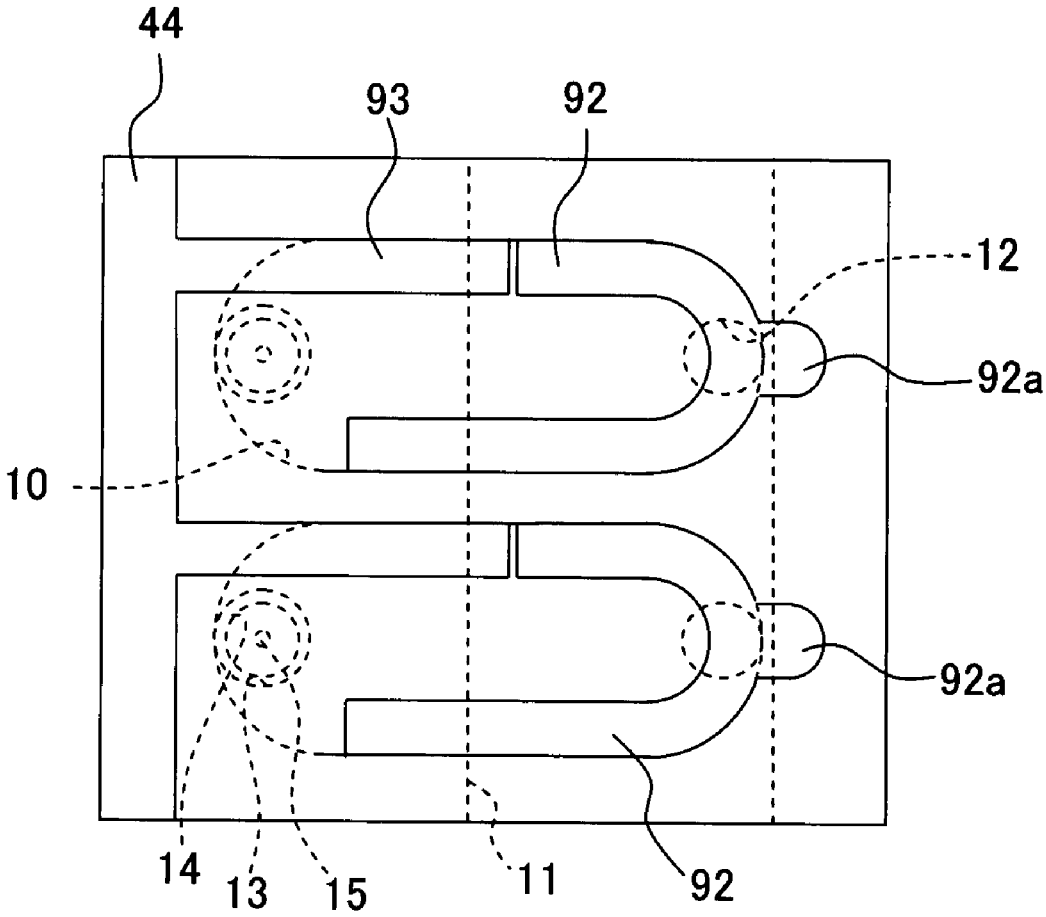
FIG. 14 is a plan view of a fifth modification corresponding to FIG. 3.

As shown in FIG. 14, first electrodes 92 may be arranged each along an outer circumferential portion of one of the pressure chambers 10, at an end portion on one side (right side in FIG. 14) in the longitudinal direction of one of the pressure chambers 10 and at portions in both end portions in the short direction of one of the pressure chambers 10; and second electrodes 93 may be each arranged in a portion of an end portion on one side (upper side in FIG. 14) in the longitudinal direction of one of the pressure chambers 10 and extending along the longitudinal direction of the pressure chamber 10 along the outer circumferential portion of the pressure chamber 10. At this time, each of the first electrodes 92 is formed to have an area greater than an area of each of the second electrodes 93. Further, each of the first electrodes 92 is connected to the driver IC 50 (see FIG. 2) by a contact point 92*a* extended from one end portion of the first electrode 92 up to the right side in FIG. 14; and the second electrodes 93, similarly as in the embodiment, are connected to the driver IC 50 via the wiring 44.

In this case, electric potentials of the first electrode 92 and the second electrode 93 are changed such that the change in the electric potentials (see FIG. 13A) of the first electrode 82 and the second electrode 83 (see FIG. 12) are opposite to those in the fourth modification. In other words, the electric potentials of the first electrode 92 and the second electrode 93 are decreased at a timing same as the timing at which the electric potentials of the first electrode 82 and the second electrode 83 are increased in the fourth modification; and the electric potentials of the first electrode 92 and the second electrode 93 are increased at a timing same as the timing at which the electric potentials of the first electrode 82 and the second electrode 83 are decreased in the fourth modification. Accordingly, similarly as in the embodiment, it is possible to jet the ink droplet from the nozzle 15 which is to perform printing by applying the pressure of a magnitude which is capable of discharging the ink in the pressure chamber 10 corresponding to the nozzle 15, and to prevent the increase in the viscosity of the ink in the nozzle 15 which is not to perform printing by applying the vibrating-pressure to the ink in the pressure chamber 10 corresponding to the nozzle 15 to thereby vibrate the meniscus of the ink in the nozzle 15. Further, in this case, since the area of the first electrode 92 is greater than the area of the second electrode 93, the vibrating-pressure is made to be assuredly smaller than the pressure of the magnitude capable of performing the jetting, and thus it is possible to prevent assuredly the ink droplet from being jetted from the nozzle 15 when the vibrating-pressure is applied.

Sixth Modification

Figure 15:
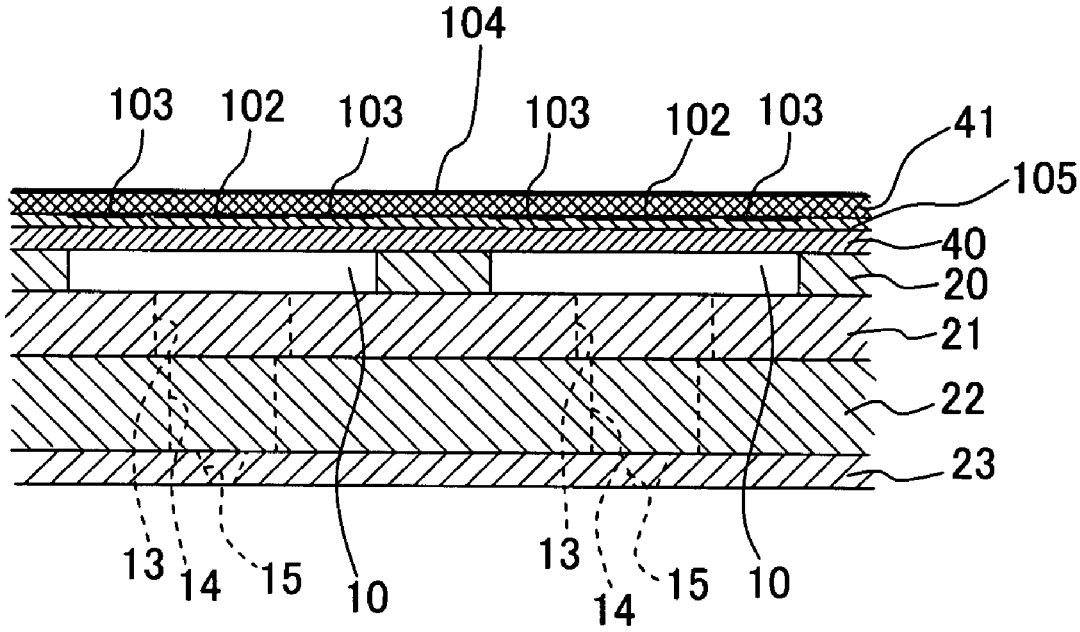
FIG. 15 is a cross-sectional view of a sixth modification corresponding to FIG. 5.

As shown in FIG. 15, an insulating layer 105 may be formed between the vibration plate 40 and the piezoelectric layer 41; a plurality of first electrodes 102 may be formed on the upper surface of the insulating layer 105 at positions each facing in a plan view the substantially central portion of one of the pressure chambers 10; a plurality of second electrodes 103 may be formed on the upper surface of the insulating layer 105 at positions each facing the outer peripheral portion of one of the pressure chambers 10; and a common electrode (third electrode) 104 may be formed entirely on the upper surface of the piezoelectric layer 41. Here, the second electrodes 103 are brought into mutual conduction by a wiring which is not shown in the diagram and which is formed on an upper surface of the insulating layer 105 at a position corresponding in a plan view to the position at which the wiring 44 is formed (see FIG. 2). In this case, similarly as in the embodiment, the electric potentials of the first and second electrodes 102, 103 are changed so as to apply the jetting-pressure to the ink in the pressure chamber 10 corresponding to the nozzle 15 which is to perform printing, thereby making it possible to jet the ink droplet from the nozzle 15; and the electric potentials of the first and second electrodes 102, 103 are changed to apply the vibrating-pressure to the ink in the pressure chamber 10 corresponding to the nozzle which is not to perform printing, thereby vibrating the meniscus of the ink in the nozzle 15 and thus agitating ink in the nozzle 15, resulting in preventing the increase in the viscosity of the ink in the nozzle 15.

Seventh Modification

Figure 16:
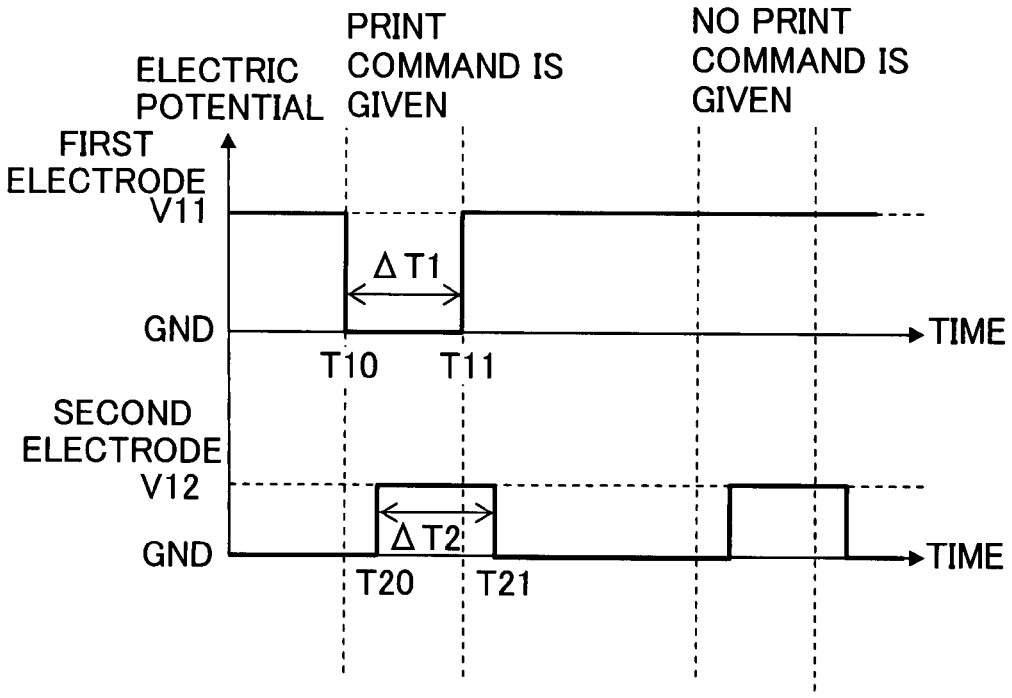
FIG. 16 is a cross-sectional view of a seventh modification corresponding to FIG. 6A.

It is not necessarily indispensable that the timing at which the electric potential of the first electrode is changed and the timing at which the electric potential of the second electrode is changed are completely concurrent (simultaneous). For example, as shown in FIG. 16, in a case that a print command is given, it is allowable that a timing T10 at which the electric potential of the first electrode is changed from V11 to the ground potential (GND) and a timing T20 at which the electric potential of the second electrode is changed from GND to V12 are shifted (not simultaneous) with each other. Alternatively, it is allowable that a timing T11 at which the electric potential of the first electrode is changed from GND to V11 and a timing T21 at which the electric potential of the second electrode is changed from V12 to GND are shifted from each other. Accordingly, even in a case that the timing at which the electric potential of the first electrode is changed and the timing at which the electric potential of the second electrode is changed are shifted to some extent, it is enough that a time ΔT1 during which the electric potential of the first electrode are changed and a time ΔT2 during which the electric potential of the second electrode are changed are overlapped.

In the above description, the jetting-pressure is applied by concurrently changing the electric potential of the first electrode and the electric potential of the second electrode corresponding to the nozzle 15 which is to perform printing. However, the jetting-pressure may be applied by changing only the electric potential of the first electrode. In this case, the vibrating-pressure is applied by changing the electric potential of the second electrode at a time at which the ink droplet is not jetted.

In the above description, the meniscus of the ink, in a nozzle which is not to perform the printing, is vibrated for the purpose of preventing the ink in the vicinity of the nozzle from being dried and becoming viscous. However, the entire ink, including the meniscus, may be vibrated for a purpose other than that as described above. For example, it is possible that in a pigment ink containing fine particles of a pigment having a low dispersibility, the ink is vibrated so as to agitate the fine particles of the pigment so as to disperse the fine particles in the ink uniformly. For example, in a white ink containing fine particles of titanium oxide, the white ink can be agitated so that the fine particles of titanium oxide are uniformly dispersed in the ink. In the above description, predetermined electric potentials are supplied to electrodes by the driver IC controlled by the controller. However, the controller may directly supply the predetermined electric potentials to the electrodes.

In the above description, an example in which the present invention is applied to an ink-jet head jetting the ink from the nozzles is explained. However, the present invention is also applicable to a liquid-droplet jetting apparatus which jets a liquid other than ink such as a reagent, a biochemical solution, a wiring material solution, an electronic material solution, for a cooling medium, and for a fuel.

What is claimed is:

1. A liquid-droplet jetting apparatus which jets droplets of a liquid to an object, the apparatus comprising:

a channel unit which includes a plurality of nozzles and a plurality of pressure chambers communicating with the nozzles respectively;

a piezoelectric actuator arranged on a surface of the channel unit and including:

a vibration plate which covers the pressure chambers;

a piezoelectric layer which is arranged on the vibration plate on a side opposite to the pressure chambers;

a plurality of first electrodes which are arranged on a surface of the piezoelectric layer at positions facing the pressure chambers respectively and which apply a first electric potential for providing a jetting-pressure to the liquid in the pressure chambers so as to jet the liquid from the nozzles;

a plurality of second electrodes which are mutually conducted and arranged on the surface of the piezoelectric layer at positions facing the pressure chambers respectively such that one second electrode which faces one of the pressure chambers is electrically conducted with another second electrode which faces another of the pressure chambers, and which apply a second electric potential for providing a vibrating-pressure to the liquid in the pressure chambers so as to vibrate the liquid without jetting the liquid; and a third electrode which is arranged on the other surface of the piezoelectric layer and which faces the first electrodes and the second electrodes across the piezoelectric layer; and an electric potential-changing mechanism which changes an electric potential of the first electrodes to the first electric potential to apply the jetting-pressure to the liquid in the pressure chambers so as to jet the liquid from the nozzles, and which changes an electric potential of the second electrodes to the second electric potential to apply the vibrating-pressure to the liquid in the pressure chambers.

2. The liquid-droplet jetting apparatus according to claim 1;

wherein the vibrating-pressure is applied to the second electrodes to vibrate a meniscus of the liquid in the nozzles.

3. The liquid-droplet jetting apparatus according to claim 2;

wherein the vibrating-pressure applied by the second electrodes is lower than a minimum jetting-pressure with which the liquid in the pressure chambers is jettable from the nozzles.

4. The liquid droplet jetting apparatus according to claim 3;

wherein the jetting-pressure applied by the first electrodes is lower than the minimum jetting-pressure; and a pressure, obtained by combining the jetting-pressure applied by the first electrodes and the vibrating-pressure applied by the second electrodes, is higher than the minimum jetting-pressure.

5. The liquid-droplet jetting apparatus according to claim 2;

wherein the electric potential-changing mechanism maintains an electric potential of the third electrode at a predetermined electric potential and controls the electric potentials of the first and second electrodes to generate, at a predetermined cycle, jetting timings in each of which the ink is jettable from the nozzles; and at each of the jetting timings an electric potential of a first electrode selected from the plurality of first electrodes is changed and the electric potential of the plurality of second electrodes is changed.

6. The liquid-droplet jetting apparatus according to claim 5;

wherein the electric potential-changing mechanism sets the electric potential of the third electrode to a ground electric potential, selectively applies a predetermined first electric potential and the ground electric potential to the first electrodes, and selectively applies a predetermined second electric potential and the ground electric potential to the second electrodes.

7. The liquid-droplet jetting apparatus according to claim 6;

wherein the first electric potential and the second electric potential are same.

8. The liquid-droplet jetting apparatus according to claim 6;

wherein the second electric potential is lower than the first electric potential.

9. The liquid-droplet jetting apparatus according to claim 2;

wherein one of the first and the second electrodes are arranged on the surface of the piezoelectric layer at positions each facing a central portion of one of the pressure chambers; and the other of the first and the second electrodes are arranged on the surface of the piezoelectric layer at positions each located outside the one of the first and the second electrodes.

10. The liquid-droplet jetting apparatus according to claim 9;

wherein the electric potential-changing mechanism changes the electric potential of the second electrodes at a timing at which the electric potential of the first electrodes is changed, in a negative correlation with a change of the electric potential of the second electrodes.

11. The liquid-droplet jetting apparatus according to claim 2;

wherein each of the first electrodes and each of the second electrodes are arranged at positions respectively facing a central portion of one of the pressure chambers; and an area of each of the first electrodes is greater than an area of each of the second electrodes.

12. The liquid-droplet jetting apparatus according to claim 11;

wherein the electric potential-changing mechanism changes the electric potential of the second electrodes at a timing at which the electric potential of the first electrodes is changed, in a positive correlation with a change of the first electrodes.

13. The liquid-droplet jetting apparatus according to claim 2;

wherein each of the first electrodes and each of the second electrodes are arranged at positions respectively facing an outer peripheral portion of one of the pressure chambers; and an area of each of the first electrodes is greater than an area of each of the second electrodes.

14. The liquid-droplet jetting apparatus according to claim 13;

wherein the electric potential-changing mechanism changes the electric potential of the second electrodes at a timing at which the electric potential of the first electrodes is changed, in a positive correlation with a change of the first electrodes.

15. A liquid-droplet jetting apparatus which jets droplets of a liquid to an object, the apparatus comprising:

a channel unit which includes a plurality of nozzles and a plurality of pressure chambers communicating with the nozzles respectively;

a piezoelectric actuator arranged on a surface of the channel unit and including:

a vibration plate which covers the pressure chambers;

a piezoelectric layer which is arranged on the vibration plate on a side opposite to the pressure chambers;

a plurality of first electrodes which are arranged on a surface of the piezoelectric layer at positions facing the pressure chambers respectively;

a plurality of second electrodes which are mutually conducted and arranged on the surface of the piezoelectric layer at positions facing the pressure chambers respectively such that one second electrode which faces one of the pressure chambers is electrically conducted with another second electrode which faces another of the pressure chambers; and a third electrode which is arranged on the other surface of the piezoelectric layer and which faces the first electrodes and the second electrodes across the piezoelectric layer; and a controller which controls electric potentials of the first electrodes and second electrodes to supply to the first electrodes a first electric potential for jetting the liquid from the nozzles, and to supply to the second electrodes a second electric potential for vibrating the liquid in the nozzles without jetting the liquid.

16. The liquid-droplet jetting apparatus according to claim 15;

wherein the vibrating-pressure applied by the second electrodes is lower than a minimum jetting-pressure with which the liquid in the pressure chambers is jettable from the nozzles.

17. The liquid-droplet jetting apparatus according to claim 15;

wherein the jetting-pressure applied by the first electrodes is lower than the minimum jetting-pressure; and a pressure, obtained by combining the jetting-pressure applied by the first electrodes and the vibrating-pressure applied by the second electrodes, is higher than the minimum jetting-pressure.

18. The liquid-droplet jetting apparatus according to claim 15;

wherein the controller maintains an electric potential of the third electrode at a predetermined electric potential and controls the electric potentials of the first and second electrodes to generate, at a predetermined cycle, jetting timings in each of which the ink is jetted from the nozzles; and at each of the jetting timings an electric potential of a first electrode selected from the plurality of first electrodes is changed and the electric potential of the plurality of second electrodes is changed.

19. The liquid-droplet jetting apparatus according to claim 18;

wherein the controller sets the electric potential of the third electrode to a ground electric potential, selectively applies a predetermined first electric potential and the ground electric potential to the first electrodes, and selectively applies a predetermined second electric potential and the ground electric potential to the second electrodes.

20. A method for jetting droplets of a liquid to an object by using a liquid-droplet jetting apparatus including: a channel unit which includes a plurality of nozzles and a plurality of pressure chambers communicating with the nozzles respectively;

and a piezoelectric actuator which is arranged on a surface of the channel unit and which includes a vibration plate covering the pressure chambers, a piezoelectric layer arranged on the vibration plate on a side opposite to the pressure chambers, a plurality of first electrodes arranged on a surface of the piezoelectric layer at positions facing the pressure chambers respectively, a plurality of second electrodes mutually conducted and arranged on the surface of the piezoelectric layer at positions facing the pressure chambers respectively, and a third electrode arranged on the other surface of the piezoelectric layer and facing the first electrodes and the second electrodes across the piezoelectric layer; the method comprising:

applying a first electric potential to the first electrodes to jet the liquid in the pressure chambers from the nozzles; and applying a second electric potential to the second electrodes to vibrate a meniscus of the liquid in the nozzles without jetting the liquid in the pressure chambers from the nozzles.

* * * * *